US006183278B1

(12) United States Patent
Hirasawa et al.

(10) Patent No.: US 6,183,278 B1
(45) Date of Patent: Feb. 6, 2001

(54) LEVER STRUCTURE OF ELECTRIC CONNECTION BOX

(75) Inventors: Hitoshi Hirasawa; Kouji Shigehisa; Chiaki Chida; Yasutaka Suzuki; Kazuhiro Watanabe; Shinobu Nakamura, all of Shizuoka (JP)

(73) Assignee: Yazaki Corporation, Tokyo (JP)

( * ) Notice: Under 35 U.S.C. 154(b), the term of this patent shall be extended for 0 days.

(21) Appl. No.: 09/488,387

(22) Filed: Jan. 14, 2000

(51) Int. Cl.[7] ..... H01R 13/62
(52) U.S. Cl. ..... 439/157
(58) Field of Search ..... 439/157, 953, 439/152, 153, 316, 372, 374, 358, 701, 351, 159; 361/683, 685, 686, 724–727, 684

(56) References Cited

U.S. PATENT DOCUMENTS 5,474,461 * 12/1995 Saito et al. ..... 439/157
5,740,012 * 4/1998 Choi ..... 361/686
6,045,384 * 8/2000 Norizuki et al. ..... 439/310
6,102,717 * 8/2000 Aoki et al. ..... 439/157

* cited by examiner

*Primary Examiner*—Khiem Nguyen
*Assistant Examiner*—J. F. Duverne
(74) *Attorney, Agent, or Firm*—Sughrue, Mion, Zinn, Macpeak & Seas, PLLC

(57) ABSTRACT

A lever member 82, having an operating portion 83, is pivotally mounted on a lever support portion mounted on an upper casing. Retaining projections 84 are elastically-deformably formed respectively on those portions of opposite side surfaces of the operating portion which can be opposed to a pair of support side plates 22, respectively. The retaining projections 84 has elasticity, and therefore a force, required for bringing the retaining projections into and out of retaining engagement with retaining projections formed on the lever support portion, can be reduced, and besides the sense of a click can be obtained. Therefore, the efficiency of the operation, the operability and the reliability can be enhanced.

14 Claims, 27 Drawing Sheets

LEVER STRUCTURE OF ELECTRIC CONNECTION BOX

BACKGRUOND OF INVENTION

1. Field of the Invention

This invention relates to a lever structure of an electric connection box in which connectors can be easily connected together and disconnected (disengaged) from each other by pivotally moving a pivotally-movable member such as an operating lever, and this lever structure is suited for use particularly in various devices and equipments, requiring a considerable force for connecting and disconnecting operations, such as a multi-pole connector used in the wiring of an automobile. More specifically, this invention relates to an electric connection box, such as a junction box, in which a mating connector in a lower cover can be positively fitted into (that is, electrically connected to) a connector portion of a connection box body with a small operating force by a lever member.

2. Related art

Various electronic equipments are mounted on current automobiles, and an electric connection box 51 as a first conventional art shown in FIGS. 1 to 5, is often used for connecting such electronic equipments together and for connecting wire harnesses together.

Electric part-mounting portions 53 and a lever structure 54 are provided on an upper surface of an upper casing 52 of the electric connection box 51, and connectors 55 are provided on that portion of an upper inner surface of the upper casing 52 disposed beneath the lever structure 54. A connector 57 and a guide post 58 are provided within a lower casing 56, and a pair of guide pins 59 are formed on opposite sides of the guide post 58, respectively. For the simplicity of the illustration, only one of the guide pins 59 is shown in FIG. 1 whereas the other guide pin 59 (not shown) is formed on that side of the guide post 58 facing away from the one guide pin 59.

An upper cover 60 covers the upper and lower casings 52 and 56.

The lever structure 54 serves to connect and disconnect the connectors 55, provided on the upper casing 52, relative to the connector 57 provided on the lower casing 56.

The lever structure 54 comprises a lever member 61 (shown in FIG. 2), and a lever support portion 71 formed on the upper surface of the upper casing 52. The lever member 61 includes a flat plate-like operating portion 62, retaining projections 62A, formed respectively on opposite sides of the operating portion 62, and a pair of cam side plates 63 extending respectively from the opposite sides of the operating portion 62. The two cam side plates 63 are symmetrical, and therefore will be described using the same reference numerals. A guide groove 64 is formed in an outer side surface of the cam side plate 63, and extends from an upper surface thereof (FIG. 2) toward the center thereof. A bottom surface of the guide groove 64 is formed into a slanting surface 64A, slanting upwardly toward the center of the cam side plate 63, and a bearing hole 65 is formed at a distal end of the guide groove 64.

The bearing holes 65 serve to pivotally support the lever member 61 on the lever support portion 71. A semi-circular guide groove 66 for guiding the guide pin 59 is formed around the bearing hole 65. However, the radius of the guide groove 66 relative to the bearing hole 65 is not uniform, and the radius of the guide groove 66, having the center disposed at the bearing hole 65, is decreasing gradually from its starting end (radius R1) toward its terminal end (radius R2) as shown in FIGS. 4 and 5.

The guide groove 66 is formed through the cam side plate 63 throughout almost the entire length thereof. However, an introducing portion 66A in the form of a groove (which is not an open-bottom groove but a closed-bottom groove of a channel-shaped cross-section) for introducing the guide pin 59 into the guide groove 66 is formed in the inner side surface of the cam side plate 63. The introducing portion 66A and the guide groove 66 communicate with each other as shown in FIGS. 4 and 5.

The lever support portion 71 includes a pair of screen-like support side plates 72, formed on the upper surface of the upper casing 52, support shafts 73, formed respectively on inner side surfaces of the support side plates 72, and retaining projections 74 formed at a left (hereinafter referred to as "front" for description purposes) end portion of the lever support portion 71 as shown in FIGS. 3 and 4.

The support shafts 73 are fitted respectively in the bearing holes 65, formed respectively in the cam side plates 63, to pivotally support the lever member 61. The retaining projections 74 can be retainingly engaged respectively with the retaining projections 62A, formed respectively on the opposite sides of the operating portion 62, to fix the lever member 61 against movement.

For mounting the lever member 61 on the lever support portion 71, the lever member is first disposed with the operating portion 62 directed upwardly as shown in phantom in FIG. 3 and then is inserted between the pair of support side plates 72 from the right (hereinafter referred to as "rear side" for description purposes) in FIGS. 1, 4 and 5. Then, the guide grooves 64, formed in the lever member 61, are brought into registry with the support shafts 73, formed respectively on the support side plates 72, and the lever member 61 is forced into the space between the support side plates 72 while spreading out the support side plates 72 by the use of a special jig. As a result, each support shaft 73 slides over the associated slanting surface 64A, and then is fitted into the associated bearing hole 65. Thereafter, when the spreading operation by the special jig is canceled, the lever member 61 is pivotally borne or supported on the lever support portion 71.

The support shafts 73 will not become disengaged respectively from the bearing holes 65 unless the support side plates 72 are spread out, and after the above fitting operation is effected, the lever member 61 can be smoothly pivotally moved.

Next, the connection of the connectors 55, mounted on the upper casing 52, to the connector 57, mounted on the lower casing 56, will be described.

The lever member 61 is pivotally mounted on the lever support portion 71 as described above, and when the operating portion 62 is brought down rearwardly, each introducing portion 66A is positioned or located at a lower position as shown in FIG. 4. In this condition, when the upper casing 52 is superposed on the lower casing 56, the guide post 58 is inserted between the pair of cam side plates 63, and at the same time each guide pin 59 is introduced into the starting end of the associated guide groove 66 (where the maximum radius R1 is provided) through the associated introducing portion 66A.

In this condition, when the operating portion 62 is held with the fingers, and is urged to be pivotally moved in a direction of arrow A, each guide pin 59 is pulled up in accordance with the decrease of the radius of the guide groove 66, so that the connector 57, which are integral with the guide pins 59, is also pulled up.

When the operating portion 62 is pivotally moved to the front position as shown in FIG. 5, each guide pin 59 is engaged with the terminal end of the associated guide groove 66. Since the radius is the maximum at this terminal end, the distance of pulling-up of the guide pins 59 and the connector 57 is the maximum, so that the connectors 55 are electrically connected to the connector 57.

Then, the retaining projections 62A, formed respectively on the opposite sides of the operating portion 62, are slid respectively over the retaining projections 74, formed respectively on the support side plates 72, so that the lever member 61 is held against pivotal movement, and the connection between the connectors 55 and the connector 57 is fixed.

For canceling this connected condition (that is, for effecting a disconnecting operation), the operating portion 62 is moved in a direction reverse to the direction of arrow A, and therefore the retaining engagement of the retaining projections 62A with the retaining projections 74 is canceled, and the operating portion 62 is returned to its original position.

In the above lever structure 54, the force for pulling up the connector 57 and for connecting the connector 57 to the connectors 55 act on the lever member 61 and the lever support portion 71. This force is large particularly where the connectors 55 and 57 are of the multi-pole type. The lever member 61 and the lever support portion 71 are molded of a synthetic resin, and are formed into a high-rigidity design in view of the above load. Therefore, the retaining projections 62A, as well as the retaining projections 74, are formed into a high-rigidity design.

For retaining the lever member 61 relative to the lever support portion 71 and for canceling this retained condition, the retaining projections 62A need to be slid over the retaining projections 74, respectively. However, because of the high-rigidity design, the operator must exert a large force for effecting and canceling this retainment, and therefore the operability and the efficiency of the operation were poor.

Unexamined Japanese Patent Publication Hei. 8-47142 discloses "a structure of connecting a connector to an electric connection box" in which the efficiency of an operation for fitting a connector into a connector portion is enhanced. However, this disclosed invention is directed to a construction in which although there are provided a pivotally-movable lever and a connector moved by the pivotal movement of the lever, two kinds of connector are connected together, utilizing the leverage of the lever.

Therefore, this disclosed invention does not teach the above structure in which the operability is enhanced when positioning the lever member which serves to connect the connectors together and to disconnect them from each other.

In a second conventional electric connection box 110', however, that portion of an outer peripheral surface 16*c* of each cam side plate 16 of the lever member 115', which is disposed in opposite relation to the introducing port 116*b*, lies generally flush with an obverse surface 117*b* of the operating portion 117 of the lever member 115' as shown in FIG. 6. Therefore, when the connection box body 111 is fitted into the lower cover 120, with the lever member 115' disposed out of the proper stand-by position (provisionally-retaining position), there has been encountered a drawback that the connection box body 11 and the lower cover 120 are completely locked to each other in a mutually-fitted condition through the retaining engagement of the elastic retaining pawls 119 of the connection box body 111 with the retaining projections 129 of the lower cover 120 although the outer peripheral surface 116*c* of each cam side plate 116 of the lever member 115' interferes with the associated guide pin 123 of the mating connector 121. In this condition, even if the lever member 115' is pivotally moved into the completely-retaining position, each guide pin 123 of the mating connector 121 will not be properly introduced into the cam groove 116*a* in the associated cam side plate 116 through the introducing port 116*b*. Therefore, the mating connector 121 in the lower cover 120 will not be properly fitted into the connector portion 113 of the connection box body 111, and the operator could not confirm this incompletely-fitted condition from the appearance of the electric connection box 110'.

And besides, when the connection box body 111 and the lower cover 120 are locked to each other in a mutually-fitted condition, with the lever member 115' disposed out of the proper stand-by position, male terminals 113*a* in the connector portion 113 of the connection box body 111 are slightly contacted respectively with female terminals 121*a* in the mating connector 121 in the lower cover 120 despite the fact that the mating connector 121 in the lower cover 120 is incompletely fitted in the connector portion 113 of the connection box body 111, as shown in FIG. 6.

Furthermore, for canceling the mutually-locked condition of the connection box body 111 and the lower cover 120 so that each guide pin 123 of the mating connector 121 can be properly introduced into the cam groove 116*a* in the associated cam side plate 116 through the associated introducing port 116*b*, a special jig is required, and it was difficult to disconnect the connection box body 111 and the lower cover 120 from each other.

FIG. 7 shows a third conventional electric connection box 201. This electric connection box 201 includes a connection box body 202, containing branch circuits formed by bus bars and the like, a lower cover 204 of a synthetic resin which closes a lower side 202*b* of the connection box body 202, and a lever member 205 pivotally mounted on the connection box body 202.

A plurality of electric part-mounting portions 206, to which electric parts, such as a relay and a fuse, are adapted to be attached, are formed on and project from an upper surface 202*a* of the connection box body 202, and a connector portion 208 (see FIGS. 8 and 9) for fitting on a mating connector 207 is provided in the lower surface 202*b*. Terminal portions of the bus bars (not shown) project into the interior of the connector portion 208, and are connected respectively to mating terminals received in the mating connector. A lever support portion 209 is formed on the upper surface 202*a* of the connection box body 202, and the lever member 205 for fitting and disconnecting the mating connector 207 relative to the connector portion 208 is pivotally supported on the lever support portion 209.

The lever support portion 209 includes a pair of spaced lever support walls 210 and 210 formed upright on the upper surface 202*a*, and support shafts 218 and 218 formed on and projecting respectively from opposed surfaces of the lever support walls 210 and 210. The lever member 205 is pivotally supported on the support shafts 218 and 218. A guide through hole 211 is formed in the connection box body 202, and extends through that portion of the upper surface 202*a* disposed between the pair of lever support walls 210 and 210, and leads to the connector portion 208. A guide post 212 of the mating connector 207 is inserted into the guide through hole 211 for guiding movement therealong, and guide pins 213, formed on the guide post 212, are engaged with the lever member 205. In FIGS. 8 and 9, reference numeral 11*a* denotes a guide pin guide groove for guiding the guide pin 213. A provisionally-retaining portion 214 is provided at one ends of the lever support walls 210 and 210 close to the electric part-mounting portions 206, and a completely-retaining portion 215 is provided at the other ends of the lever support walls 210 and 210 remote from the electric part-mounting portions 206.

The provisionally-retaining portion 214 has elastic retaining pawls 216 and 216 projecting in the direction of projecting of the lever support walls 210 and 210. Retaining projections 224 and 224, formed on and projecting respectively from opposite sides of an operating portion 222 (more fully described later) of the lever member 205, can be retainingly engaged respectively with the retaining pawls 216 and 216, thereby holding the lever member 205 in a provisionally-retained position. Similarly, the completely-retaining portion 215 has elastic retaining pawls 217 and 217 projecting in the direction of projecting of the lever support walls 210 and 210. The retaining projections 224 and 224, formed respectively on the opposite sides of the operating portion 222 of the lever member 205, can be retainingly engaged respectively with the retaining pawls 217 and 217, thereby holding the lever member 205 in a completely-retained position.

The lever member 205 includes a pair of cam side plates 221 and 221, and the operating portion 222 provided between the pair of cam side plates 221 and 221. Each of the cam side plates 221 and 221 has a bearing hole 219, receiving the support shaft 218 of the associated lever support wall 210, and a cam groove 220 for receiving the associated guide pin 213 of the mating connector 207. The cam groove 220 is formed around the support shaft 218, and an introducing port 223 for introducing the guide pin 213 into the cam groove 220 therethrough is formed at a starting end of the cam groove 220. The cam groove 220, formed in each of the two cam side plates 221, has such an arcuate shape that the distance between the cam groove 220 and the bearing hole 219 is decreasing gradually from the introducing port 223 toward a terminal end of the cam groove 220. The retaining projections 224 and 224 are formed respectively on the opposite sides of the operating portion 222.

A connector retaining portion 225 for retaining the mating connector 207 is formed on a bottom surface 204*a* of the lower cover 204. This connector retaining portion 225 includes a retaining post 226 projecting from the bottom surface 204*a*, an engagement arm 227 formed on the retaining post 226, and a placing wall 228 formed in surrounding relation to the retaining post 226.

The retaining post 226 is inserted into an internal space 212*a* in the guide post 212, formed on the mating connector 207, so as to guide the mating connector 207 into a predetermined position on the bottom surface 204*a*. An outwardly-directed engagement projection 227*a* is formed on the engagement arm 227, and this engagement projection 227*a* is engaged with a retaining portion 212, projecting from an inner surface 212*b* of the guide post 212, thereby preventing the mating connector 207 from being disengaged from the connector retaining portion 225. The placing wall 228 has a stopper wall 228*b* formed on a bottom of an internal space 228*a* thereof into which the guide post 212 is inserted. When the lower end surface of the guide post 212 abuts against the bottom of the internal space 228*a*, the stopper wall 228*b* serves to determine the height of the mating connector 207 relative to the bottom surface 204*a*.

As shown in FIG. 10(*b*), the retaining post 226 is inserted into the internal space 212*a* in the guide post 212 while the guide post 212 is inserted into the internal space 228*a* in the placing wall 228, and the mating connector 207 is set at a predetermined position within the lower cover 204. Then, in this condition, when the lower side 202*b* of the connection box body 202 is covered with the lower cover 204, the guide post 212 is inserted into the guide through hole 211, and each guide pin 213 is introduced into the associated cam groove 220 through the associated introducing port 223. When the lower side of the connection box body 202 is not covered with the lower cover 204, the lever member 205 is held in such a position that the introducing ports 223 are located at an open end of the guide through hole 211, with the operating portion 222 (disposed at the right side in FIG. 8) engaged with the provisionally-retaining portion 214.

In this condition, when the operating portion 222 is operated to pivotally move the lever member 205 in a counterclockwise direction (FIG. 8) about the support shafts 218, the guide pins 213 are moved relative to the cam grooves 220, respectively. As a result of the relative movement between each guide pin 213 and the associated cam groove 220, the guide pin 213 is moved toward the bearing hole 219, so that the mating connector 207 is pulled up into the connector portion 208 of the connection box body 202. When the lever member 205 is further pivotally moved, the mating connector 207 is completely fitted into the connector portion 208. In this condition, the operating portion 222 of the lever member 205 is retained by the completely-retaining portion 215, thereby holding the mating connector 207 in the fitted condition relative to the connector portion 208 as shown in FIG. 9.

In this electric connection box 201, the mating connector 207 is retained on the connector retaining portion 225 formed on the lower cover 204, and in this condition the lower side of the connection box body 202 is covered with the lower cover 204, and by doing so, the mating connector 207, together with the lower cover 204, can be set on the connection box body 202, and the mating connector can be easily set in the proper fitting position relative to the connector portion 208 of the connection box body 202.

However, when the bottom surface 204*a* is warped, for example, as a result of deformation of the lower cover 204, the connector retaining portion 225 is displaced out of position, or is tilted relative to the bottom surface 204*a* as shown in FIGS. 10 and 11. In such a case, the mating connector 207, set on the connector retaining portion 225, is also displaced out of the proper fitting position relative to the connector portion 208 of the connection box body 202, which invites a problem that the mating connector can not be fitted into the connector portion 208.

Further, when the lever member 205 is not operated, or when the lever member 205 is half operated as shown in FIG. 13, the mating connector 207 can not be completely fitted into the connector portion 208, and hence is disposed in an incompletely-fitted condition. In such an incompletely-fitted condition, there is a possibility that the terminals (not shown) in the connector portion 208 fail to contact the terminals (not shown) in the mating connector 207, or incompletely contact them.

SUMMARY OF INVENTION

This invention seeks to overcome the above problems, and an object of the invention is to provide a lever structure of an electric connection box in which connectors can be smoothly connected together and disconnected from each other with a small operating force, thereby achieving an excellent operability.

Another object of the invention is to provide an electric connection box in which a connection box body can not be completely fitted into a lower cover unless a lever member is disposed in a proper stand-by position (provisionally-retaining position), and with this construction an incomplete fitting engagement of a mating connector of the lower cover with a connector portion of the connection box body can be easily confirmed, and besides the connection box body and the lower cover can be easily disconnected from each other.

Another object of this invention is to provide a structure of fitting a connector into an electric connection box, in which the mating connector can be set in a proper fitting position relative to a connector portion.

Another object of this invention is to provide a structure of fitting a connector into an electric connection box, in which a mating connector can be positively fitted into a connector portion, and a non-contacted condition and an incompletely-contacted condition of terminals are prevented.

The above object of the present invention has been achieved by lever structures of an electric connection box described in the following structures:

A lever structure of an electric connection box wherein a lever support portion, having a pair of support side plates, is formed on an upper casing on which a connector is mounted, and a lever member is pivotally supported on support shafts formed respectively on the support side plates, and the lever member is pivotally moved about the support shafts, so that guide pins, provided at a lower casing, are guided and moved upward and downward respectively by guide grooves, formed in the lever member, thereby connecting and disconnecting a connector, which is provided at the lower casing, and is movable upward and downward together with the guide pins, relative to the first-mentioned connector, and retaining projections, formed on an operating portion of the lever member, are retainingly engaged respectively with retaining projections, formed respectively on the support side plates, in a connector-connecting position; CHARACTERIZED in that the retaining projections are elastically-deformably formed respectively on those portions of opposite side surfaces of the operating portion which can be opposed to the pair of support side plates, respectively.

A lever structure of an electric connection box wherein a lever support portion, having a pair of support side plates, is formed on an upper casing on which a connector is mounted, and a lever member is pivotally supported on support shafts formed respectively on the support side plates, and the lever member is pivotally moved about the support shafts, so that guide pins, provided at a lower casing, are guided and moved upward and downward respectively by guide grooves, formed in the lever member, thereby connecting and disconnecting a connector, which is provided at the lower casing, and is movable upward and downward together with the guide pins, relative to the first-mentioned connector, and retaining projections, formed on an operating portion of the lever member, are retainingly engaged respectively with retaining projections, formed respectively on the support side plates, in a connector-connecting position; provided in that the operating portion of the lever member has a hollow configuration.

The lever structure of the electric connection box according to the present invention, in which retaining projections are formed respectively on side surfaces of the pair of support side plates, and are retainingly engaged respectively with the retaining projections of the lever member to position the lever member when the connector-connecting operation is to be effected.

The lever structure of the electric connection box according to the present invention, in which the operating portion is formed by long plate portions, which can be easily elastically deformed, and short plate portions which are less elastically deformable.

In the lever structure of the electric connection box described above, the retaining projections are elastically-deformably formed respectively on those portions of opposite side surfaces of the operating portion (of the lever member) which can be opposed to the pair of support side plates (which pivotally supports the lever member), respectively. Therefore, the lever member can be brought into and out of retaining engagement with one ends of the two support side plates without lowering the rigidity of the operating portion.

In the lever structure of the electric connection box described above, the operating portion, which has the retaining projections for fixing the lever member, and can be operated to pivotally move the lever member, has a hollow configuration. Therefore, the whole of the operating portion, including the retaining projections, can be elastically deformed without lowering the rigidity of the retaining projections.

In the lever structure of the electric connection box described above, the retaining projections are formed respectively on the side surfaces of the pair of support side plates, and are retainingly engaged respectively with the retaining projections of the lever member to position the lever member when the connector-connecting operation is to be effected. Therefore, the position of the lever member can be easily fixed when effecting the connector-connecting operation.

In the lever structure of the electric connection box described above, the operating portion of a hollow configuration is formed by the long plate portions, which can be easily elastically deformed, and the short plate portions which are less elastically deformable. Therefore, particularly, the long plate portions of the operating portion can be easily elastically deformed, and the retaining engagement of the retaining projections, as well as the cancellation of this retaining engagement, can be effected with a small force.

According to the present invention, there is provided an electric connection box comprises a connection box body, which has a lever member pivotally supported on an upper surface thereof through support shafts of lever support portions, and has a connector portion provided at a lower side thereof; and a lower cover, which removably receives the connection box body in a manner to cover the lower side of the connection box body, and has a mating connector movably provided within the lower cover, the mating connector being adapted to be brought into and out of fitting engagement with the connector portion; wherein each of guide pins, formed on the mating connector, is introduced and engaged in a cam groove, formed in an associated cam side plate of the lever member, through a guide pin-introducing port of the cam groove, and the lever member is pivotally moved from a provisionally-retaining position to a completely-retaining position so as to guide each guide pin along the cam groove, thereby moving the mating connector in such a direction as to fit it into the connector portion; provided in that there is provided retaining means which locks the connection box body and the lower cover to each other in a mutually-fitted condition only when the lever member is in the provisionally-retaining position where each guide pin can be introduced into the introducing port of the cam groove, and the retaining means is provided on those portions of the connection box body and the lower cover to be opposed to each other; and a projected portion is formed on that portion of an outer peripheral surface of the cam side plate, disposed in opposite relation to the introducing port, and projects outwardly beyond an obverse surface of an operating portion of the lever member.

In this electric connection box, if the lever member is not disposed in the proper stand-by position (provisionally-retaining position) when the connection box body is to be attached to the lower cover, this can be easily confirmed. Therefore, the mating connector in the lower cover is prevented from being incompletely fitted into the connector portion of the connection box body, and therefore the contact between terminals of the mating connector and terminals of the connector portion, which would occur when the mating connector in the lower cover is incompletely fitted in the connector portion of the connection box body, is positively prevented. And besides, when the lever member is not disposed in the proper stand-by position (provisionally-retaining position), the mutually-fitted condition of the connection box body and the lower cove will not be locked, and therefore there is no need to cancel the mutually-fitted condition of the connection box body and the lower cover, and the connection box body and the lower cover can be easily disconnected from each other, and the lever member can be easily returned to the proper stand-by position.

In the electric connection box of the present invention, the projected portion is formed integrally on the outer peripheral surface of the cam side plate, and has a generally arcuate shape, and projects to the vicinity of the upper surface of the connection box body.

In this electric connection box, with the simple construction in which the configuration of the outer peripheral surface of the cam side plate of the lever member is changed without the need for changing the configuration of the connection box body, the incomplete fitting engagement of the mating connector of the lower cover with the connector portion of the connection box body can be easily confirmed, and the number of the component parts and the cost can be reduced.

In order to achieve the above object, the present invention provides a structure of fitting a connector into an electric connection box wherein the electric connection box comprises a connection box body, which has a lever support portion formed at an upper surface thereof, and has a connector portion formed at a lower side thereof for fitting on the mating connector; a lower cover, which covers the lower side of the connection box body, and has a connector retaining portion formed on a bottom surface thereof, the mating connector to be fitted into the connector portion being adapted to be retained on the connector retaining portion; and a lever member which is pivotally supported on support shafts of the lever support portion, and can be pivotally moved to bring the mating connector into and out of fitting engagement with the connector portion; provided in that guide means for guiding the mating connector, which is to be retained on the connector retaining portion, into a proper fitting position relative to the connector portion, is provided on a side wall of the lower cover.

In this fitting structure, even if the connector retaining portion is displaced out of position, or is tilted because of a warp of the bottom surface of the lower cover, the guide means guides the mating connector into the proper fitting position relative to the connector portion when retaining the mating connector on the connector retaining portion. Therefore, the mating connector can be positively fitted into the connector portion.

The present invention is directed to the structure of fitting the connector into the electric connection box according to claim 1, and the guide means comprises a pair of guide rails which are formed on the side wall of the lower cover so as to hold and guide one end portion of the mating connector, and guide ribs for being engaged respectively with the guide rails are formed on the one end portion of the mating connector.

In this fitting structure, when retaining the mating connector on the connector retaining portion, the one end portion of the mating connector is held between and guided by the pair of guide rails formed on the side wall of the lower cover. Therefore, even if the connector retaining portion is displaced out of position because of a warp of the bottom surface of the lower cover, the mating connector is guided into the proper fitting position by the pair of guide rails, and therefore the connector retaining portion is corrected into its proper position through the mating connector, so that the mating connector can be properly fitted into the connector portion.

The present invention is directed to the structure of fitting the connector into the electric connection box, and the connector retaining portion includes a retaining post, which is formed upright on the bottom surface of the lower cover, and can be inserted into the mating connector, an engagement arm which is formed on the retaining post, and can be engaged with the mating connector to retain the mating connector relative to the lower cover, and a placing wall which is formed upright on the bottom surface in surrounding relation to the retaining post, and the mating connector can be placed on the placing wall.

In this fitting structure, for retaining the mating connector on the connector retaining portion, the retaining post is inserted into the mating connector, so that the mating connector is placed on the placing wall. At the same time, the engagement arm is engaged with the mating connector. As a result, the mating connector is retained in the predetermined position on the lower cover.

In order to achieve the above object, the present invention provides a structure of fitting a connector into an electric connection box wherein the electric connection box comprises a connection box body, which has electric part-mounting portions and a side wall formed on and projecting from an upper surface thereof, and has a connector portion formed at a lower side thereof; and a lever member which is pivotally supported on a lever support portion on the connection box body, and can be pivotally moved to bring the mating connector into and out of fitting engagement with the connector portion; and when the mating connector is completely fitted in the connector portion, a distal end of the mating connector projects beyond the upper surface; CHARACTERIZED in that the lever member is supported on the lever support portion in such a manner that when the mating connector is completely fitted in the connector portion, a height of the lever member from the upper surface is equal to at least one of a height of the side wall from the upper surface, a height of the distal end of the mating connector from the upper surface and a height of the electric part-mounting portions from the upper surface.

In this fitting structure, when the mating connector is completely fitted into the connector portion by pivotally moving the lever member, the lever member is equal in height to at least one of the electric part-mounting portions, the side wall and the distal end of the mating connector, and therefore it can be easily and positively confirmed with the eyes whether or not the lever member has been properly operated.

If the lever member is in a half -operated condition, that is, if the mating connector is not completely fitted in the connector portion, the lever member is projected beyond the electric part-mounting portions, the side wall and the distal end of the mating connector in a direction away from the upper surface, and therefore such an incompletely-fitted condition can be easily recognized by confirming the thus projected lever member with the eyes.

The present invention is directed to the structure of fitting the connector into the electric connection box, and the lever support portion includes a pair of support walls, formed on and projecting from the upper surface of the connection box body, and support shafts formed on and projecting respectively from opposed surfaces of the support walls, and the lever member includes a pair of cam side plates, and an operating portion which is provided between the pair of cam side plates, and can be operated to pivotally move the lever member, and each of the cam side plates has a bearing hole, receiving and bearing the associated support shaft, and a cam groove for receiving an associated guide pin of the mating connector, and in the completely-fitted condition, a height of the operating portion from the upper surface is equal to at least one of the height of the side wall from the upper surface, the height of the distal end of the mating connector from the upper surface and the height of the electric part-mounting portions from the upper surface.

In this connector fitting structure, when the mating connector is completely fitted into the connector portion by pivotally moving the operating portion of the lever member, the height of the operating portion from the upper surface is equal to at least one of the height of the side wall from the upper surface, the height of the distal end of the mating connector from the upper surface and the height of the electric part-mounting portions from the upper surface. Therefore, it can be easily and positively confirmed whether or not the lever member has been properly operated or pivotally moved.

If the lever member is in a half-operated condition, that is, if the mating connector is not completely fitted in the connector portion, the operating portion is projected beyond the electric part-mounting portions, the side wall and the distal end of the mating connector in a direction away from the upper surface, and therefore such an incompletely-fitted condition can be easily recognized by confirming the thus projected operating portion with the eyes.

Whether or not the completely-fitted condition is achieved can be confirmed merely by confirming whether or not the operating portion is equal in height to at least one of the electric part-mounting portions, the side wall and the distal end of the mating connector, and therefore the confirming operation is easy, and mistakes in the operation can be reduced.

The present invention is directed to the structure of fitting the connector into the electric connection box, and the plurality of the electric part-mounting portions are formed on and project from the upper surface, and end surfaces of the electric part-mounting portions, an end surface of the side wall, an end surface of the distal end of the mating connector and the lever member are disposed in a common plane.

In this connector fitting structure, when the mating connector is completely fitted in the connector portion, the lever member is disposed in the plane in which the end surfaces of the electric part-mounting portions, the end surface of the side wall and the end surface of the distal end of the mating connector lie. Therefore, the completely-fitted condition can be easily and positively confirmed by confirming this condition with the eyes.

If the mating connector is incompletely fitted in the connector portion, the lever member is not disposed in the plane in which the plurality of electric part-mounting portions, the side wall and the distal end of the mating connector lie, but projects beyond this plane. Therefore, the fact that the mating connector is incompletely fitted in the connector portion can be easily confirmed by confirming the thus projected lever member with the eyes.

DETAILED DESCRIPTION OF PREFERRED EMBODIMENTS

First embodiment

Figure 14:
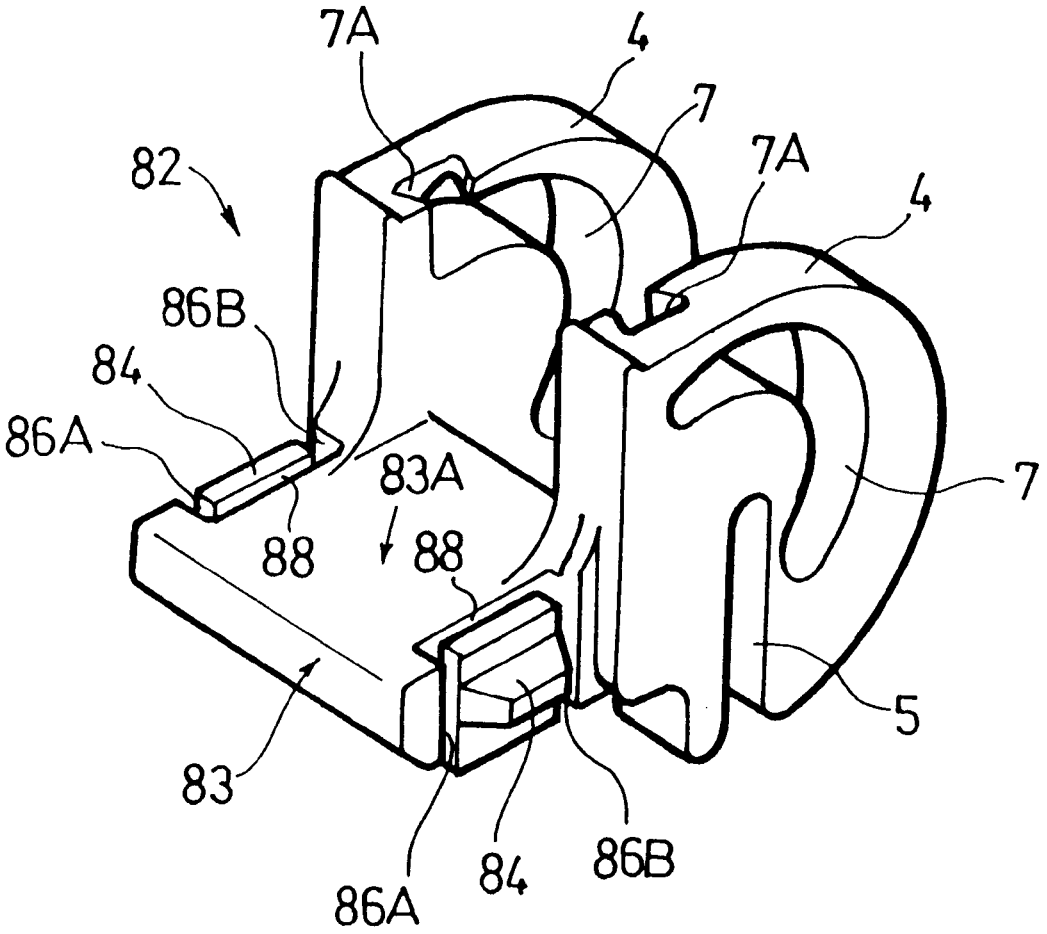
FIG. 14 is a perspective view showing a lever member in a first embodiment of a lever structure of the present invention for an electric connection box.
Figure 15:
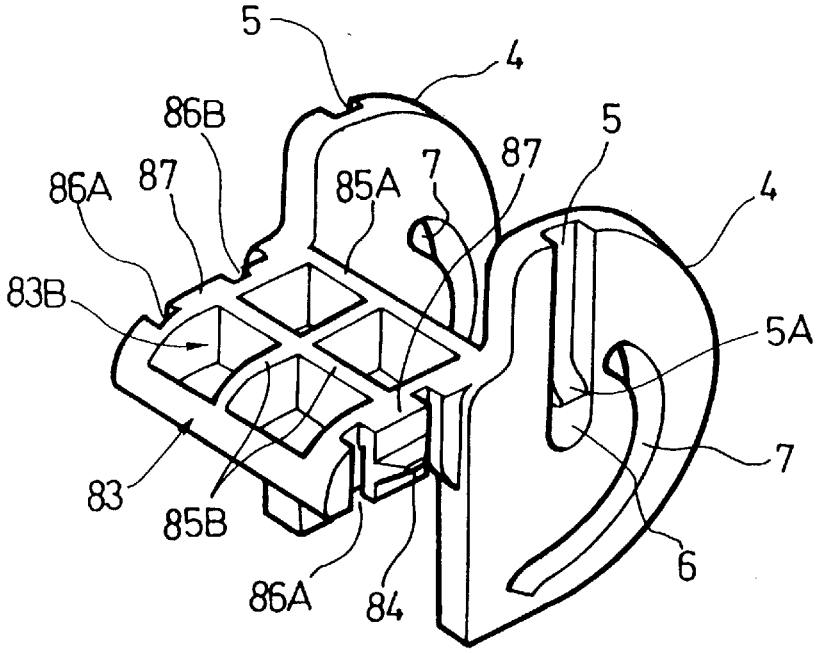
FIG. 15 is a perspective view showing the construction of the lever member.
Figure 16:
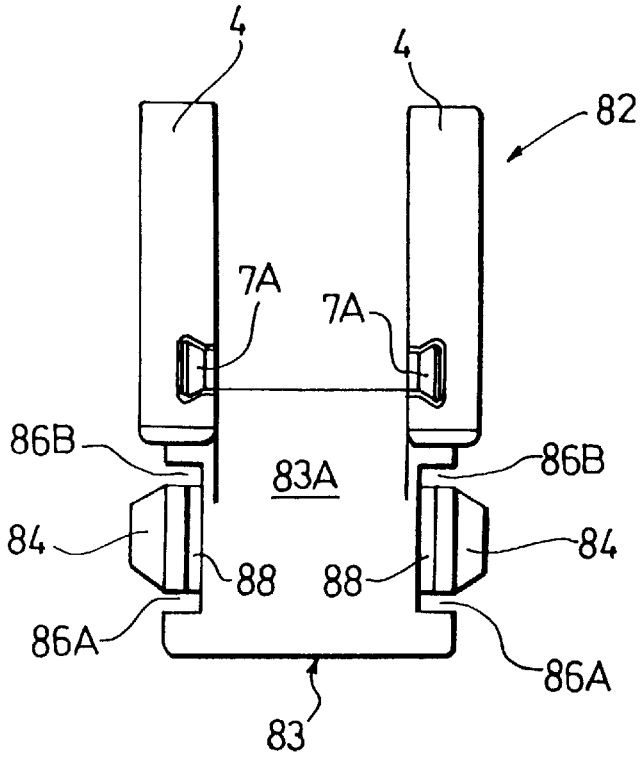
FIG. 16 is a plan view showing the construction of the lever member.
Figure 17:
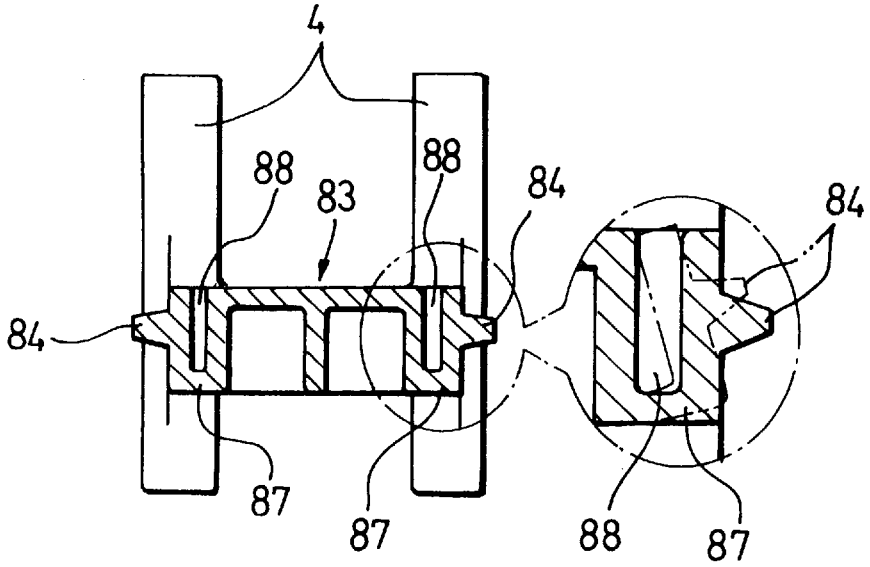
FIG. 17 is a cross-sectional view showing the construction of an operating portion.
Figure 19:
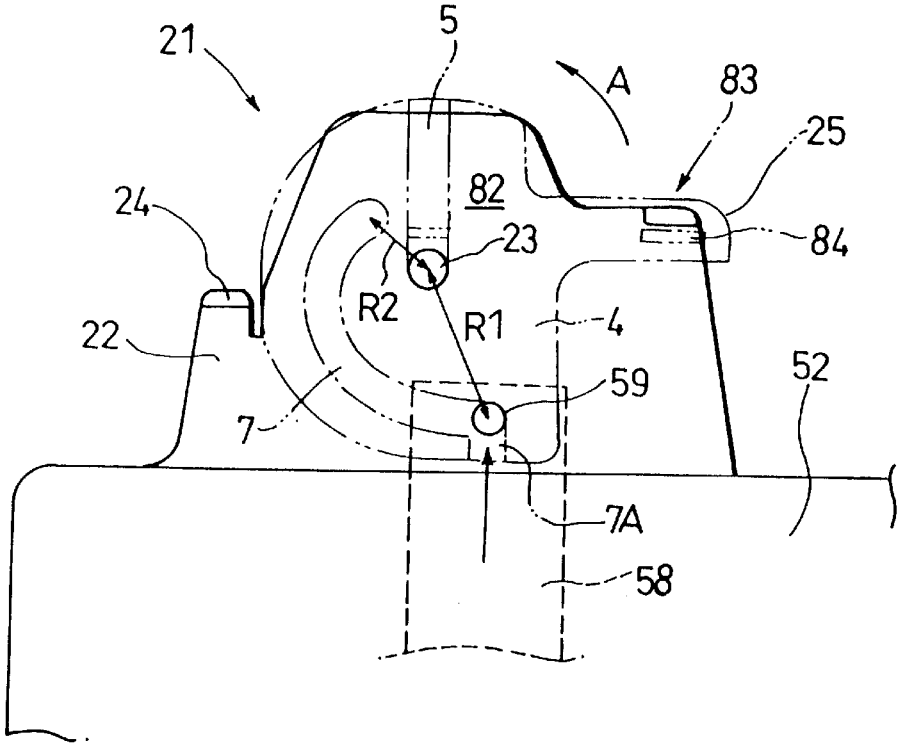
FIG. 19 is a schematic, side-elevational view showing an important portion of the lever structure.
Figure 20:
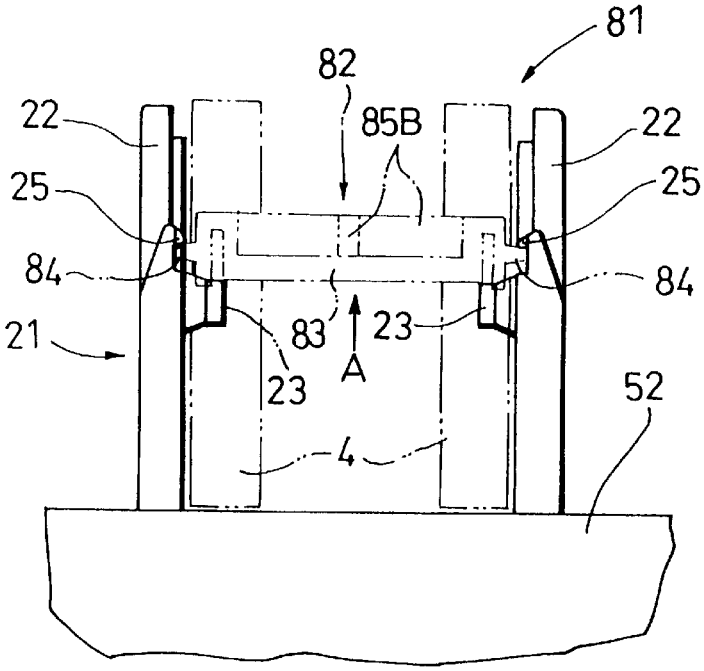
FIG. 20 is a side-elevational view showing the construction of a lever support portion.
Figure 21:
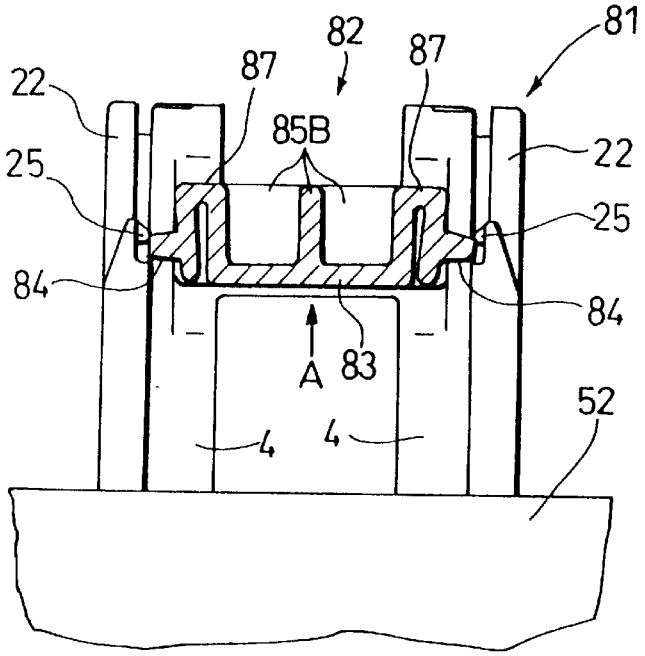
FIG. 21 is a side-elevational view of the lever structure, showing the cancellation of the retainment of retaining projections.

A first embodiment of a lever structure of the present invention for an electric connection box will now be described with reference to FIGS. 14 to 23. FIGS. 14 and 15 are perspective views showing the appearance and construction of a lever member, FIG. 16 is a plan view of the lever member, FIG. 17 is a cross-sectional view showing the construction of an operating portion, FIG. 18 is a side-elevational view of the lever member, FIG. 19 is a schematic, side-elevational view showing the construction of an inner side surface of a lever support portion, and FIGS. 20 and 21 are side-elevational views showing various conditions concerning the retainment of the lever member and the cancellation of the retainment.

In the description of the first embodiment, the drawings and reference numerals, used in the description of the first conventional art, will be used where necessary.

The lever structure 81 broadly comprises the lever support portion 21 fixed to an upper casing 52 (shown in FIGS. 19 to 23), and the lever member 82 pivotally mounted on the lever support portion 21.

Figure 18:
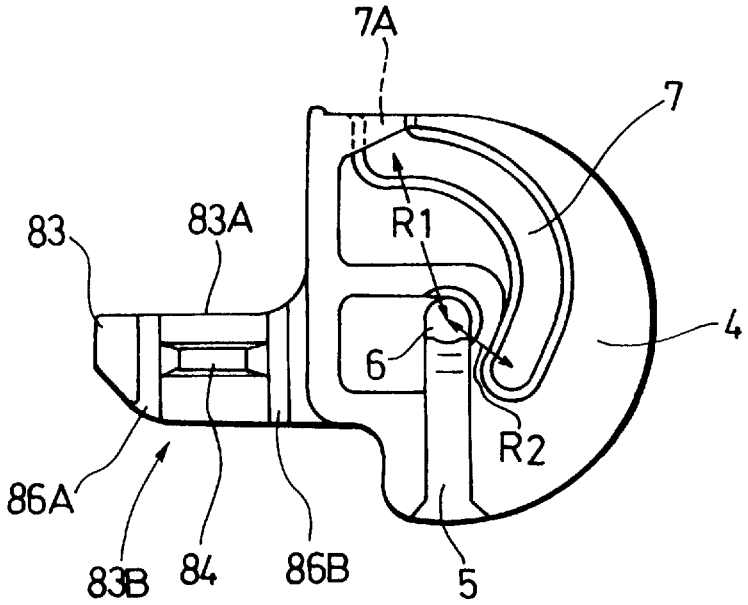
FIG. 18 is a side-elevational view showing the construction of the lever member.

As shown in FIGS. 14 to 18, the lever member 82 includes a flat plate-like operating portion 83, retaining projections 84, formed respectively on opposite sides of the operating portion 83, and a pair of cam side plates 4 extending respectively from the opposite sides of the operating portion 83. The two cam side plates 4 are symmetrical, and therefore will be described using the same reference numerals. As shown in FIGS. 14, 15 and 18, a guide groove 5 is formed in an outer side surface of the cam side plate 4, and extends from one end thereof toward the center thereof. A bottom surface of the guide groove 5 is formed into a slanting surface 5A, slanting upwardly toward the center of the cam side plate 4, and a bearing hole 6 is formed at a distal end of the guide groove 5.

The bearing holes 6 serve to pivotally support the lever member 82 on the lever support portion 21 (more fully described later). A semi-circular guide groove 7 for guiding a guide pin 59 as described in the prior art is formed around the bearing hole 6. However, the radius of the guide groove 7 relative to the bearing hole 6 is not uniform, and the radius of the guide groove 7, having the center disposed at the bearing hole 6, is decreasing gradually from its starting end (radius R1) toward its terminal end (radius R2) as shown in FIG. 18.

As shown in FIGS. 14, 15 and 18, the guide groove 7 is formed through the cam side plate 4 throughout almost the entire length thereof. However, an introducing portion 7A in the form of a groove (which is not an open-bottom groove but a closed-bottom groove of a channel-shaped cross-section) for introducing the guide pin 59 into the guide groove 7 is formed in the inner side surface of the cam side plate 4. The introducing portion 7A and the guide groove 7 communicate with each other as shown in FIGS. 14 and 18.

The overall configuration of the lever member 82 has been described above, and the lever member 82 of this first embodiment has the following noteworthy feature.

Namely, one side surface (hereinafter referred to as "obverse surface" for description purposes) 83A of the operating portion 83 is flat as shown in FIG. 14, whereas an outer peripheral frame 85A and a cross-shaped reinforcing rib 85B are formed on the other side surface (hereinafter referred to as "reverse surface" for description purposes) 83B. Therefore, the operating portion 83 will not be elastically deformed.

As shown in FIGS. 14 to 17, the retaining projections 84 are formed respectively on the opposite sides of the operating portion 83, and the two retaining projections 84 are symmetrical, and therefore only one of them will be described using common reference numerals. Slits 86A and 86B are formed at opposite sides of the retaining projection 84, respectively. The retaining projection 84 is connected at one end (upper end in FIG. 15) to a portion of the side surface of the operating portion 83, and a gap 88 is formed between the retaining projection 84 and the side surface of the operating portion 83 except at this interconnecting portion 87.

With this construction of the operating portion 83, the whole of the retaining projection 84 can be elastically moved or turned about the interconnecting portion 87. Therefore, the retaining projection 84, when pressed from the outer side, is deformed from a condition, indicated in solid lines (in an enlarged view of FIG. 17), into a condition indicated in phantom. When this pressing operation is canceled, the retaining projection 84 is returned or restored into the position indicated in the solid lines because of the elasticity of the interconnecting portion 87.

The deformation and restoration of the retaining projection 84 can be effected repeatedly.

The operation for retaining the lever member relative to the lever support portion 21, as well as the operation for canceling this retainment, will be described in detail after describing the construction of the lever support portion 21.

Next, the construction of the lever support portion 21 will be described. As shown in FIGS. 19 to 23, the lever support portion 21 includes a pair of opposed, screen-like support side plates 22, formed on the upper surface of the upper casing 52. A support shaft 23, a retaining projection 24 and a retaining projection 25 are formed on an inner side surface of each of the support side plates 22. The support shafts 23 are fitted respectively in the bearing holes 6, formed in the lever member 82, to pivotally support the lever member 82. The lever member 82 is mounted on the lever support portion 21, using a special jig as in the conventional construction.

The retaining projections 24 correspond to the retaining projections 74 described above for the conventional construction. In this embodiment, the retaining projections 25 are also provided at the rear portion of the lever support portion 21. The retaining projections 25 serve to position and fix the lever member 82 when each guide pin 59 is to be introduced into the associated guide groove 7 through the introducing portion 7A after the operating portion 83 of the lever member 82 is brought down rearwardly as shown in FIG. 19.

Next, the retaining operation and the retainment-canceling operation in the lever structure 81 will be described.

When the retained condition, shown in FIG. 19, is viewed from the rear side, it will be appreciated that the retaining projections 84, formed respectively on the opposite sides of the operating portion 83, are retainingly engaged with the retaining projections 25, respectively, as shown in FIG. 20. Therefore, the lever member 82 is held against movement in forward, backward, right and left directions, and the position of each introducing portion 7A relative to the associated guide pin 59 will not change, so that the guide pin 59 can be accurately introduced into the guide groove 7.

For connecting the connector 57 to the connectors 55 as described above, the retaining engagement of each retaining projection 84 with the associated retaining projection 25 need to be canceled, and then the lever member 82 need to be urged or moved in a direction of arrow A in FIG. 19 (in an upward direction A in FIG. 20).

In this first embodiment, when the operating portion 83 is urged in the upward direction A, the retaining projection 84, which is originally disposed vertically as indicated in phantom in FIG. 20, is elastically deformed to close the gap 88 as indicated in solid lines in FIG. 21, and can slide over the retaining projection 25. Therefore, the retaining engagement between the retaining projections 84 and 25 can be canceled with a small force, thus enhancing the operability. Then, by pivotally moving the lever member 82 in the direction of arrow A after thus canceling the retainment of the lever member 82, the guide pins 59 are gradually pulled up through the respective guide grooves 7.

Figure 22:
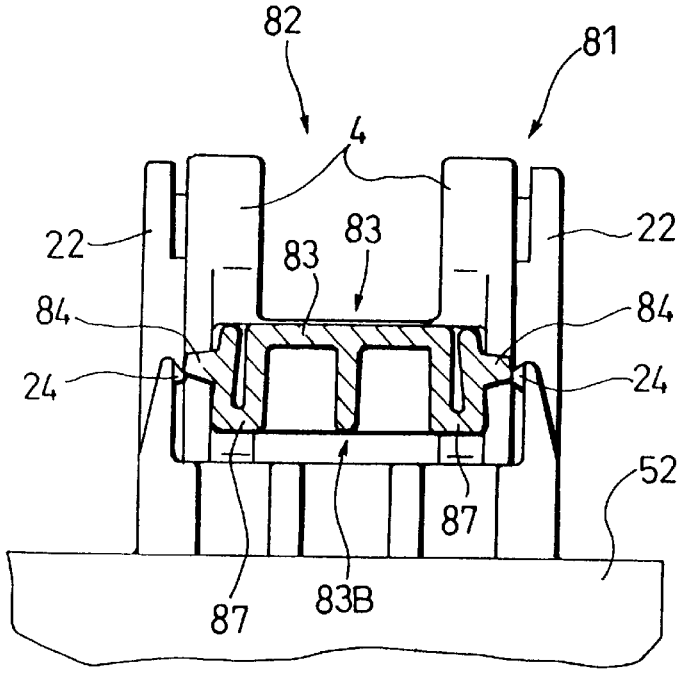
FIG. 22 is a side-elevational view of the lever structure, showing the retaining operation of the retaining projections.
Figure 23:
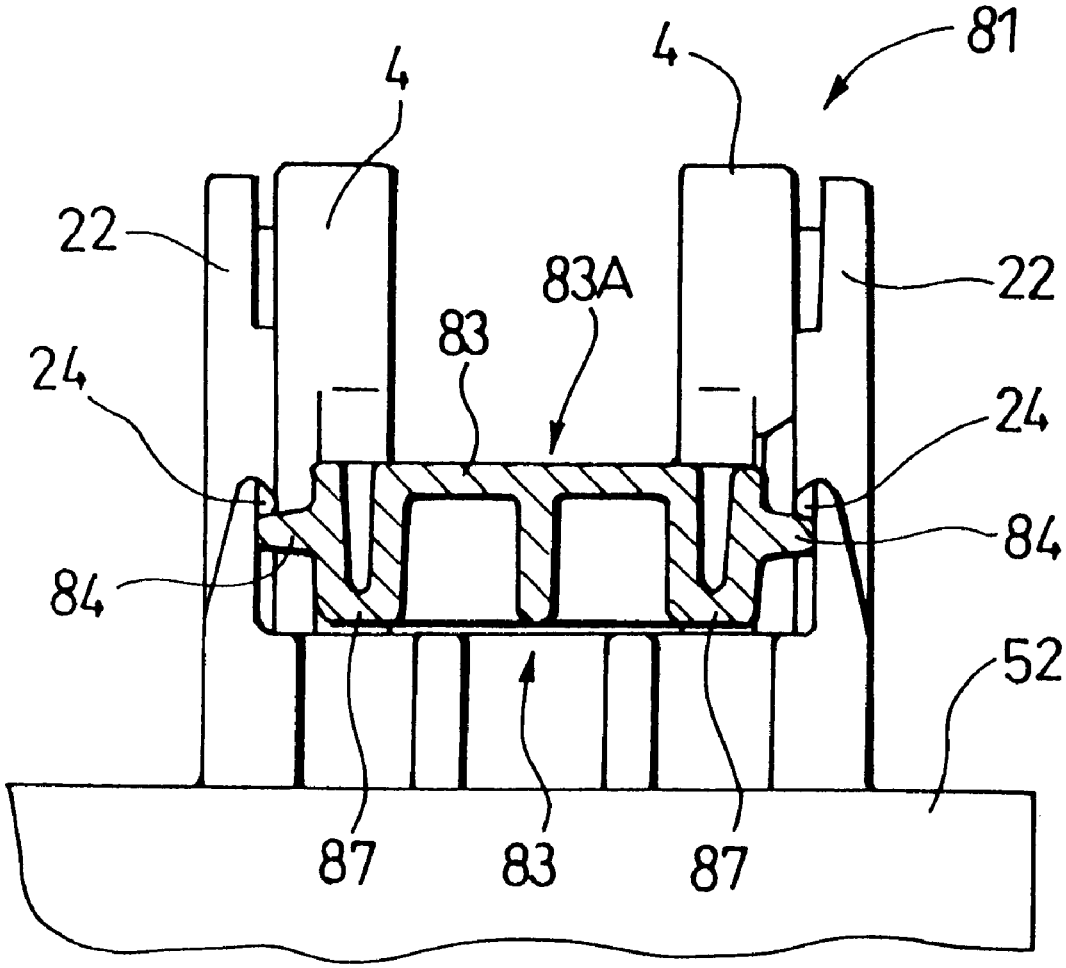
FIG. 23 is a side-elevational view of the lever structure, showing a retained condition of the retaining projections.

In FIGS. 21 to 23, the cross-section of the operating portion 83 is shown for the better understanding of the retaining engagement of the retaining projection 84 and the retainment-canceling operation.

When the lever member 82 is brought down forwardly, the obverse surface 83A of the operating portion 83 is directed upwardly whereas the reverse surface 83B, having the reinforcing rib 85B, is directed downwardly as shown in FIG. 22, and in this condition the retaining projections 84 abut against the retaining projections 24, respectively. Then, when the operating portion 83 is further urged, each retaining projection 84 is pressed from the outer side, and is elastically deformed to close the gap 88 as shown in FIG. 22.

This elastic deformation is made conspicuous by urging the operating portion 83, and when the retaining projection 84 slides over the retaining projection 24, it is restored into its original shape as shown in FIG. 23. In this condition, the guide pin 59 is located at the terminal end (radius R2) of the guide groove 7, so that the connector 57 is connected to the connectors 55 as in the conventional construction.

In the condition shown in FIG. 23, the retaining engagement between the retaining projections 84 and 24 will not be accidentally canceled. Therefore, the condition of connection between the connectors 55 and the connector 57 is quite stable.

For canceling the retained condition shown in FIG. 23, the finger is engaged with the lower side of the operating portion 83, and then the operating portion 83 is urged upwardly. As a result, the retaining projection 84 is again elastically deformed to close the gap 88, and is further elastically deformed by continuing the urging of the operating portion 83, so that the retained condition (retainment) is canceled.

Then, when the lever member 82 is urged to be pivotally moved in a direction reverse to the direction of arrow A, the connector 57 gradually moves downward, and is disconnected from the connectors 55. When the lever member 82 is retained in the condition shown in FIG. 19, each guide pin 59 is disposed in registry with the associated introducing portion 7A, and the connector 57 can be completely separated from the lever structure 81. The force to deform the retaining projections 84 is required for canceling the retaining engagement of the retaining projections 84 with the retaining projections 24, and therefore the lever member 82 will hardly be accidentally moved from the retained position.

Second Embodiment

Figure 24:
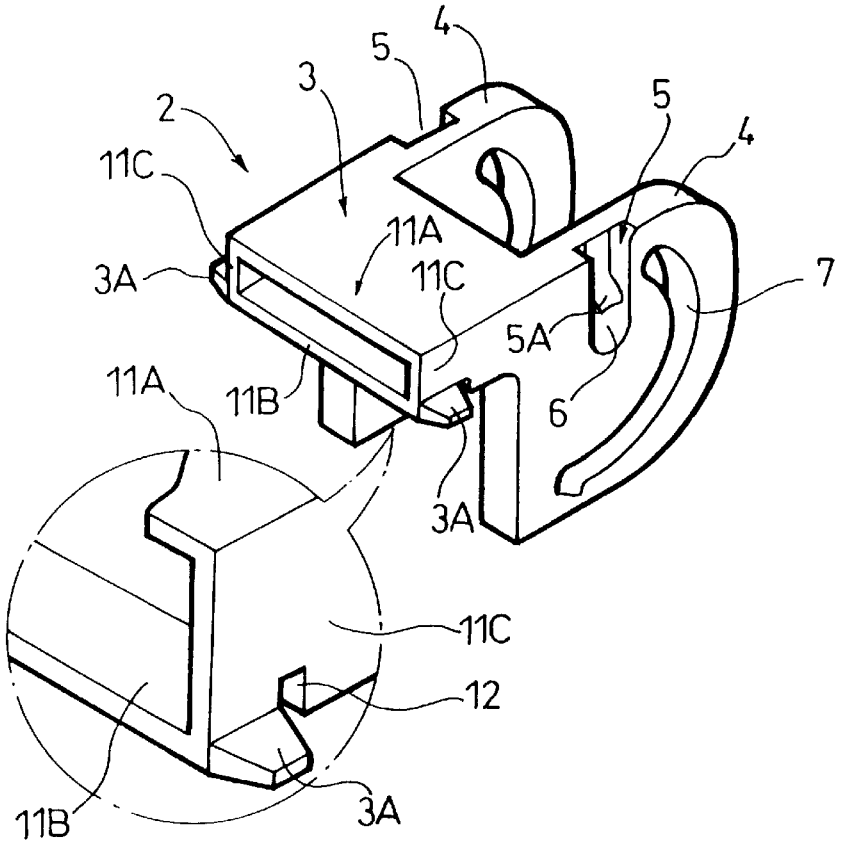
FIG. 24 is a partly-enlarged, perspective view showing a lever member in a second embodiment of a lever structure of the present invention for an electric connection box.
Figure 25:
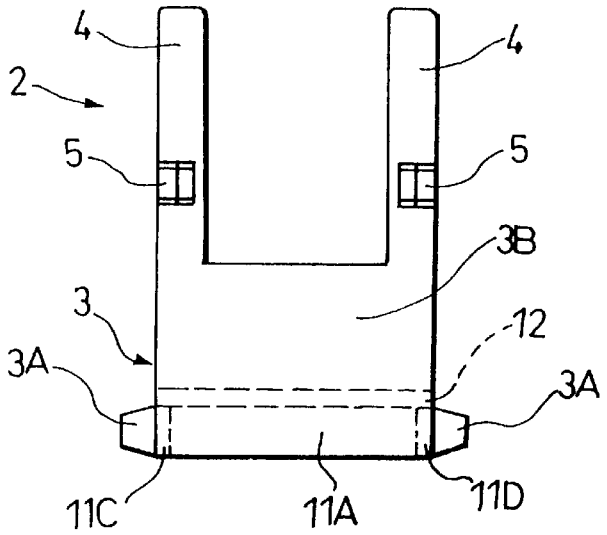
FIG. 25 is a plan view showing the construction of the lever member.
Figure 26:
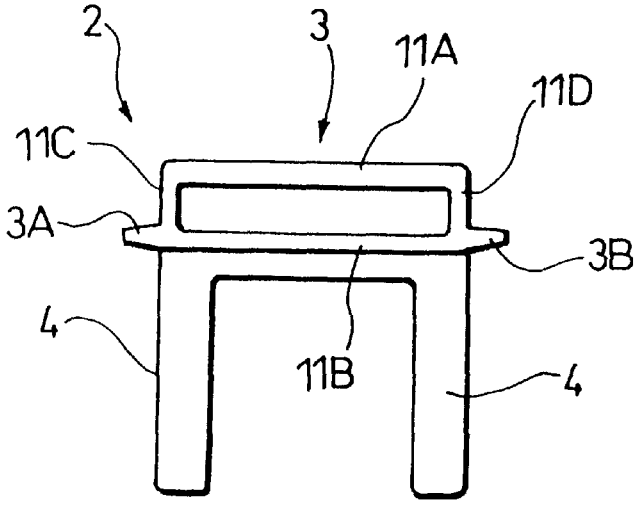
FIG. 26 is a front-elevational view showing the construction of the lever member.
Figure 27:
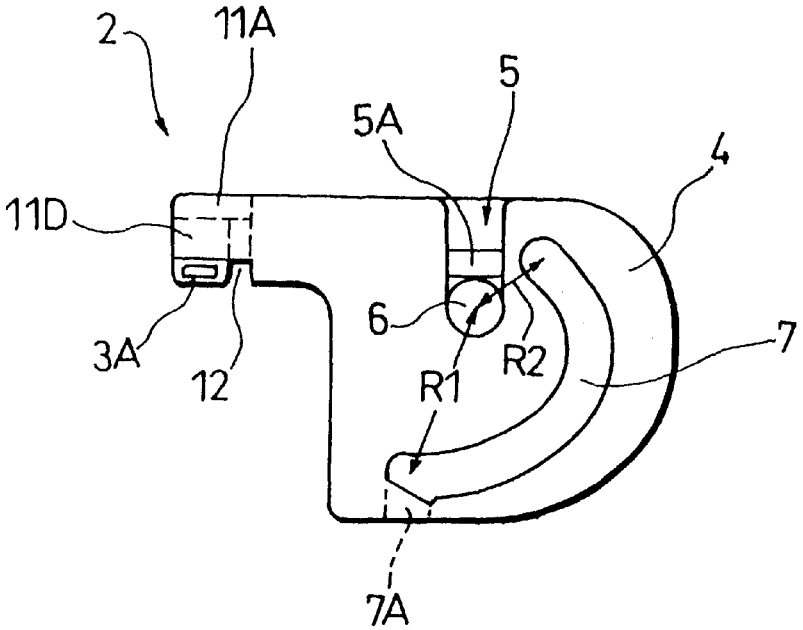
FIG. 27 is a side-elevational view showing the construction of the lever member.
Figure 28:
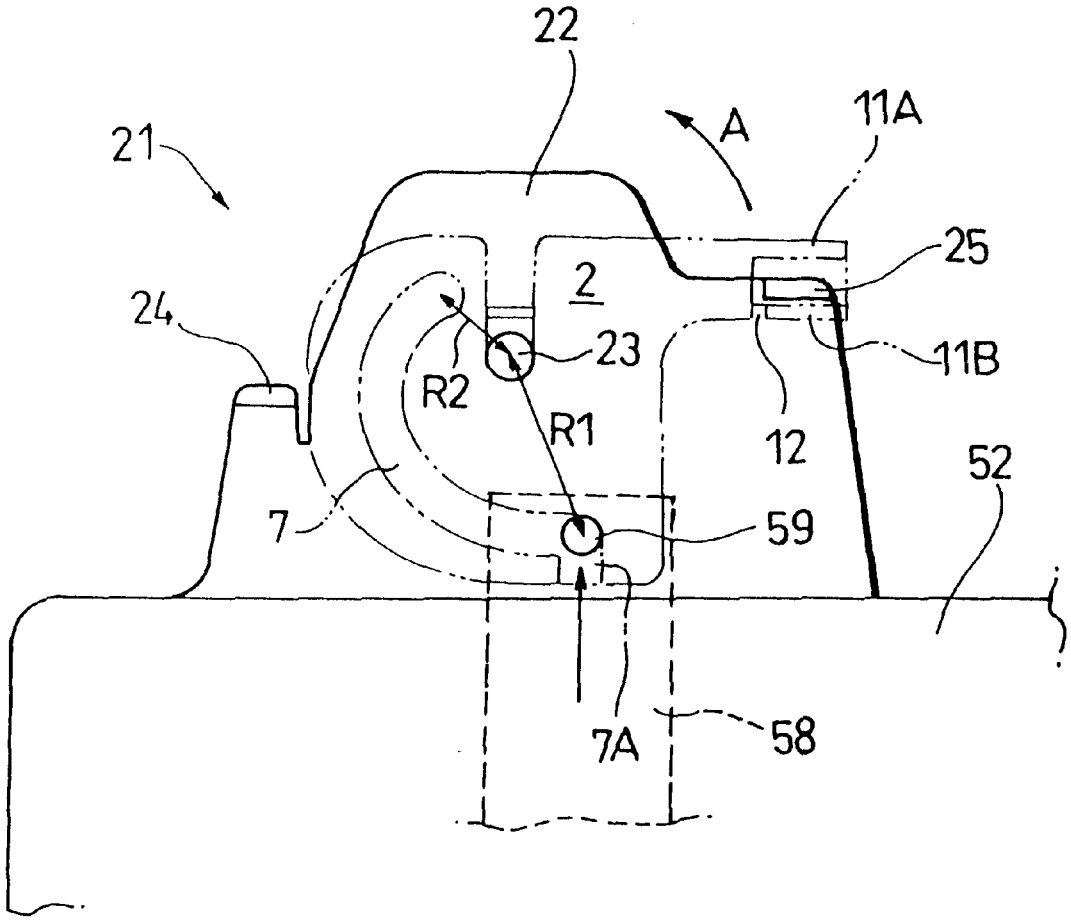
FIG. 28 is a schematic, side-elevational view showing an important portion of the lever structure.

Next, a second embodiment of a lever structure of the present invention for an electric connection box will be described with reference to FIGS. 24 to 32. FIG. 24 is a perspective view showing the appearance and construction of a lever member, FIG. 25 is a plan view of the lever member, FIG. 26 is a front-elevational view of the lever member, FIG. 27 is a side-elevational view of the lever member, FIG. 28 is a schematic, side-elevational view showing the construction of an inner side surface of a lever support portion, and FIGS. 29 to 32 are side-elevational views showing various conditions concerning the retainment of the lever member and the cancellation of the retainment.

In the description of this second embodiment, the drawings and reference numerals, used in the description of the prior art and the first embodiment, will be used where necessary.

The lever structure 1 broadly comprises the lever support portion 21 fixed to an upper casing 52 (shown in FIGS. 28 to 32), and the lever member 2 pivotally mounted on the lever support portion 21.

The lever member 2 includes a flat plate-like operating portion 3, retaining projections 3A, formed respectively on opposite sides of the operating portion 3, and a pair of cam side plates 4 extending respectively from the opposite sides of the operating portion 3. The two cam side plates 4 are symmetrical, and therefore will be described using the same reference numerals.

As shown in FIGS. 24 and 27, a guide groove 5 is formed in an outer side surface of the cam side plate 4, and extends from an upper surface thereof toward the center thereof. A bottom surface of the guide groove 5 is formed into a slanting surface 5A, slanting upwardly toward the center of the cam side plate 4, and a bearing hole 6 is formed at a distal end of the guide groove 5.

The bearing holes 6 serve to pivotally support the lever member 2 on the lever support portion 21 (more fully described later). A semi-circular guide groove 7 for guiding a guide pin 59 as described in the prior art is formed around the bearing hole 6. However, the radius of the guide groove 7 relative to the bearing hole 6 is not uniform, and the radius of the guide groove 7, having the center disposed at the bearing hole 6, is decreasing gradually from its starting end (radius R1) toward its terminal end (radius R2) as shown in FIG. 27.

As shown in FIGS. 24 and 27, the guide groove 7 is formed through the cam side plate 4 throughout almost the entire length thereof. However, an introducing portion 7A in the form of a groove (which is not an open-bottom groove but a closed-bottom groove of a channel-shaped cross-section) for introducing the guide pin 59 into the guide groove 7 is formed in the inner side surface of the cam side plate 4. The introducing portion 7A and the guide groove 7 communicate with each other as shown in FIGS. 27 and 28.

The overall configuration of the lever member 2 has been described above, and the lever member 2 of this second embodiment has the following noteworthy feature.

As shown in FIG. 26, the operating portion 3 has a hollow configuration defined by long plate portions 11A and 11B and short plate portions 11C and 11D. However, this hollow configuration is not formed over the entire region of the operating portion 3, but is formed at that portion of the operating portion 3 corresponding to the width of the retaining projections 3A.

Referring further to the hollow configuration, a groove 12 is formed in that portion of the lower surface of the operating portion 3, disposed adjacent to the retaining projections 3A, and extends across the operating portion 3. That portion of the operating portion 3, lying between the groove 12 and the front end of the operating portion 3, has the follow configuration. The rear end portion of the operating portion 3, (on which the cam side plates 4 are formed), extending rearwardly from the groove 12, is thickened (solid). Therefore, the pair of cam side plates 4 are firmly interconnected by the thickened portion 3B of the operating portion 3, and therefore can adequately withstand a load as applied when connecting the connector 57 to the connectors 55 in the conventional construction.

Thus, the front end portion of the operating portion 3, extending forwardly from the groove 12, has the hollow configuration, and with this construction this front end portion, extending forwardly from the groove 12, is made elastic independently of the thickened portion 3B. Elasticity is thus imparted to part of the operating portion 3, and with this construction the retainment of the lever member 2 relative to the lever support portion 21, as well as the cancellation of this retainment, can be effected quite easily with a good operability.

The operation for retaining the lever member relative to the lever support portion 21, as well as the operation for canceling this retainment, will be described in detail after describing the construction of the lever support portion 21.

Next, the construction of the lever support portion 21 will be described. As shown in FIGS. 28 to 32, the lever support portion 21 includes a pair of opposed, screen-like support side plates 22, formed on the upper surface of the upper casing 52. A support shaft 23, a retaining projection 24 and a retaining projection 25 are formed on an inner side surface of each of the support side plates 22. The support shafts 23 are fitted respectively in the bearing holes 6, formed in the lever member 2, to pivotally support the lever member 2. The lever member 2 is mounted on the lever support portion 21, using a special jig as in the conventional construction.

The retaining projections 24 correspond to the retaining projections 74 described above for the conventional construction. In this embodiment, the retaining projections 25 are also provided at the rear portion of the lever support portion 21. The retaining projections 25 serve to position and fix the lever member 2 when each guide pin 59 is to be introduced into the associated guide groove 7 through the introducing portion 7A after the operating portion 3 of the lever member 2 is brought down rearwardly as shown in FIG. 28.

Next, the retaining operation and the retainment-canceling operation in the lever structure 1 will be described.

Figure 29:
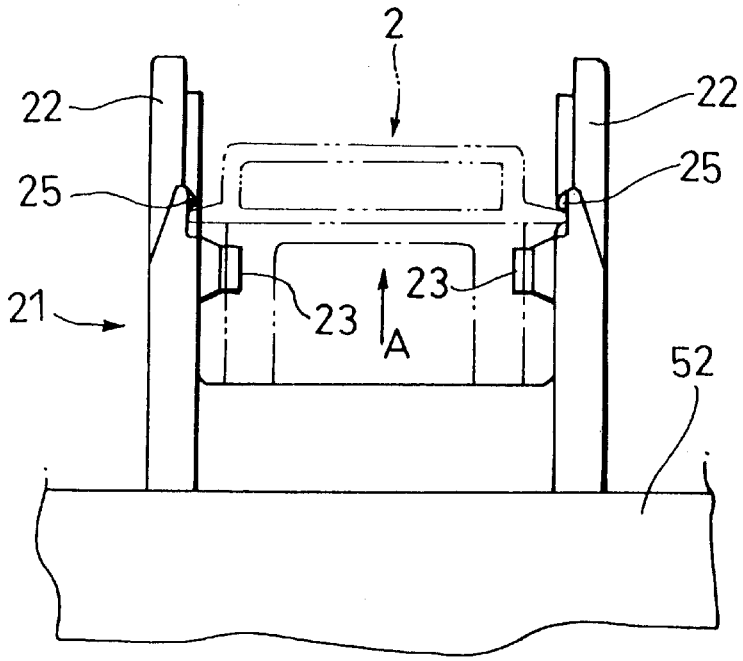
FIG. 29 is a side-elevational view showing the construction of a lever support portion.

When the retained condition, shown in FIG. 28, is viewed from the rear side, it will be appreciated that the retaining projections 3A, formed respectively on the opposite sides of the operating portion 3, are retainingly engaged with the retaining projections 25, respectively, as shown in FIG. 29. Therefore, the lever member 2 is held against movement in forward, backward, right and left directions, and the position of each introducing portion 7A relative to the associated guide pin 59 will not change, so that the guide pin 59 can be accurately introduced into the guide groove 7.

For connecting the connector 57 to the connectors 55 as described above, the retaining engagement of each retaining projection 3A with the associated retaining projection 25 need to be canceled, and then the lever member 2 need to be urged or moved in a direction of arrow A in FIG. 28 (in an upward direction A in FIG. 29).

Figure 30:
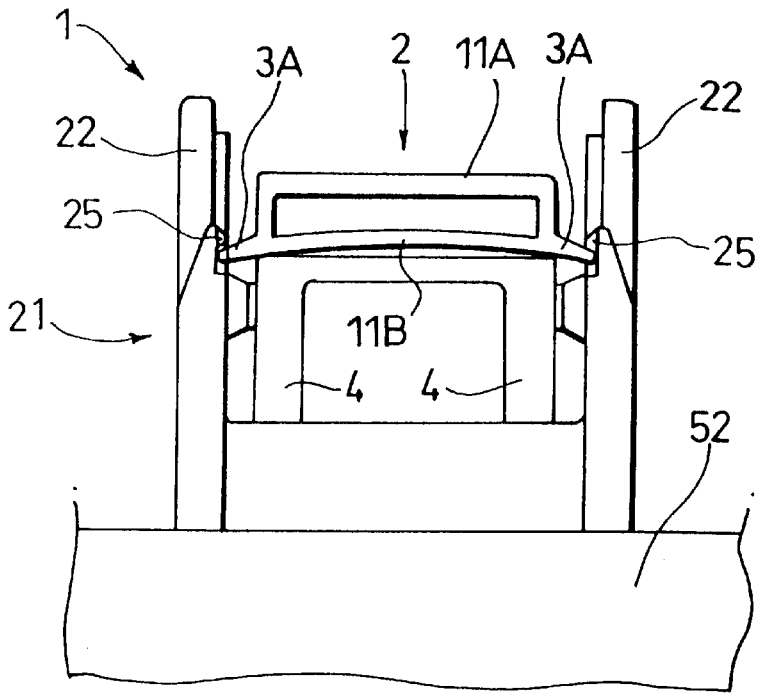
FIG. 30 is a side-elevational view of the lever structure, showing elastic deformation of the lever member.

In this first embodiment, when the operating portion 3 is urged in the upward direction A, the long plate portion 11B and the retaining projection 3A, which are originally straight, are elastically deformed into an arcuate shape as shown in FIG. 30. This deformation never occurs if the operating portion is thickened (solid). In this second embodiment, however, that portion of the operating portion 3, corresponding to the width of the retaining projections 3A, can be elastically deformed. And besides, the long plate portion 11B, disposed adjacent to the retaining projections 3A, is deformed to a larger degree than the other long plate portion 11A.

Therefore, the retaining engagement between the retaining projections 3A and 25 can be canceled with a small force, thus enhancing the operability.

Figure 31:
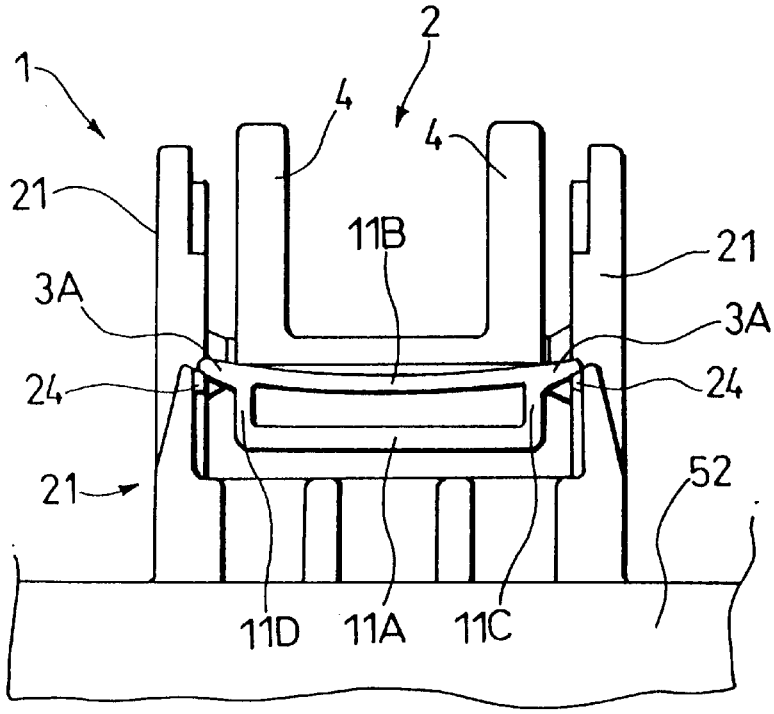
FIG. 31 is a side-elevational view of the lever structure, showing an operation for retaining the lever member.

By pivotally moving the lever member 2 in the direction of arrow A after thus canceling the retainment of the lever member 2, the guide pins 59 are gradually pulled up through the respective guide grooves 7. Then, when the lever member 2 is brought down forwardly, the long plate portion 11A of the operating portion 3 is directed downwardly whereas the other long plate portion 11B is directed downwardly, and in this condition the retaining projections 3A abut against the retaining projections 24, respectively. Then, when the operating portion 3 is further urged, the long plate portion 11B and the retaining projections 3A, formed respectively on the opposite sides of this long plate portion 11B, are elastically deformed into an arcuate shape as shown in FIG. 31.

Figure 32:
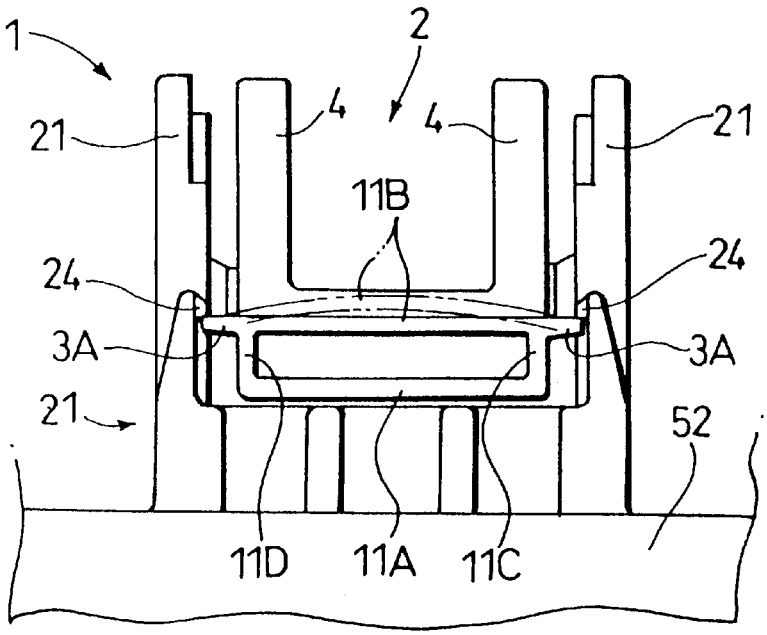
FIG. 32 is a side-elevational view of the lever structure, showing the cancellation of the retainment of the lever member.

This elastic deformation is made conspicuous by urging the operating portion 3, and when the retaining projection 3A slides over the retaining projection 24, the long plate portion 11B and the retaining projections 3A are restored into the original condition (that is, a straight condition) as shown in FIG. 32. In this condition, the guide pin 59 is located at the terminal end (radius R2) of the guide groove 7, so that the connector 57 is connected to the connectors 55 as in the conventional construction and the first embodiment. When the retaining projection 3A is to slide over the retaining projection 24, the long plate portion 11B, disposed adjacent to the retaining projections 3A, is deformed to a larger extent than the other long plate portion 11A, and besides the force is exerted in a direction to open the groove 12, and therefore the end portion can be easily deformed, so that the retaining operation is easy.

In the condition shown in FIG. 32, the retaining engagement between the retaining projections 3A and 24 will not be accidentally canceled. Therefore, the condition of connection between the connectors 55 and the connector 57 is quite stable.

For canceling the retained condition shown in FIG. 32, the finger is engaged with the lower side of the operating portion 3, and then the operating portion 3 is urged upwardly. As a result, the long plate portion 11B and the retaining projections 3A are again elastically deformed into an arcuate shape as indicated in phantom in FIG. 32, and are further elastically deformed by continuing the urging of the operating portion 3, so that the retained condition (retainment) is canceled.

Then, when the lever member 2 is urged to be pivotally moved in a direction reverse to the direction of arrow A, the connector 57 gradually moves downward, and is disconnected from the connectors 55. When the lever member 2 is retained in the condition shown in FIG. 28, each guide pin 59 is disposed in registry with the associated introducing portion 7A, and the connector 57 can be completely separated from the lever structure 1. The force to deform the two long plate portions 11A and 11B is required for canceling the retaining engagement of the retaining projections 3Awith the retaining projections 24, and therefore the lever member 2 will hardly be accidentally moved from the retained position.

Although the specific embodiments of the present invention have been described above, the present invention is not limited to the above embodiments, and various modifications can be made. For example, in the second embodiment, although the retaining projections 3A are formed in such a manner that these projections 3A extend from the long plate portion 11B, each retaining projection 3A may be formed on the outer surface of the short plate portion 11C, 11D intermediate the upper and lower edges thereof. In this case, the elasticity of the long plate portions 11A and 11B can be utilized equally.

The number of the retaining projections, formed on each support side plate 22, is not limited to two, and more than two retaining projections may be formed in a multi-stage manner. This construction can meet with a variation in the distance between the connector 57 and the connectors 55, and can be used in a multi-purpose manner.

One of each retaining projection 84 and each retaining projection 24 (retaining projection 25) may be a retaining recess in which the retaining projection is retainingly engageable.

Third Embodiment

Figure 1:
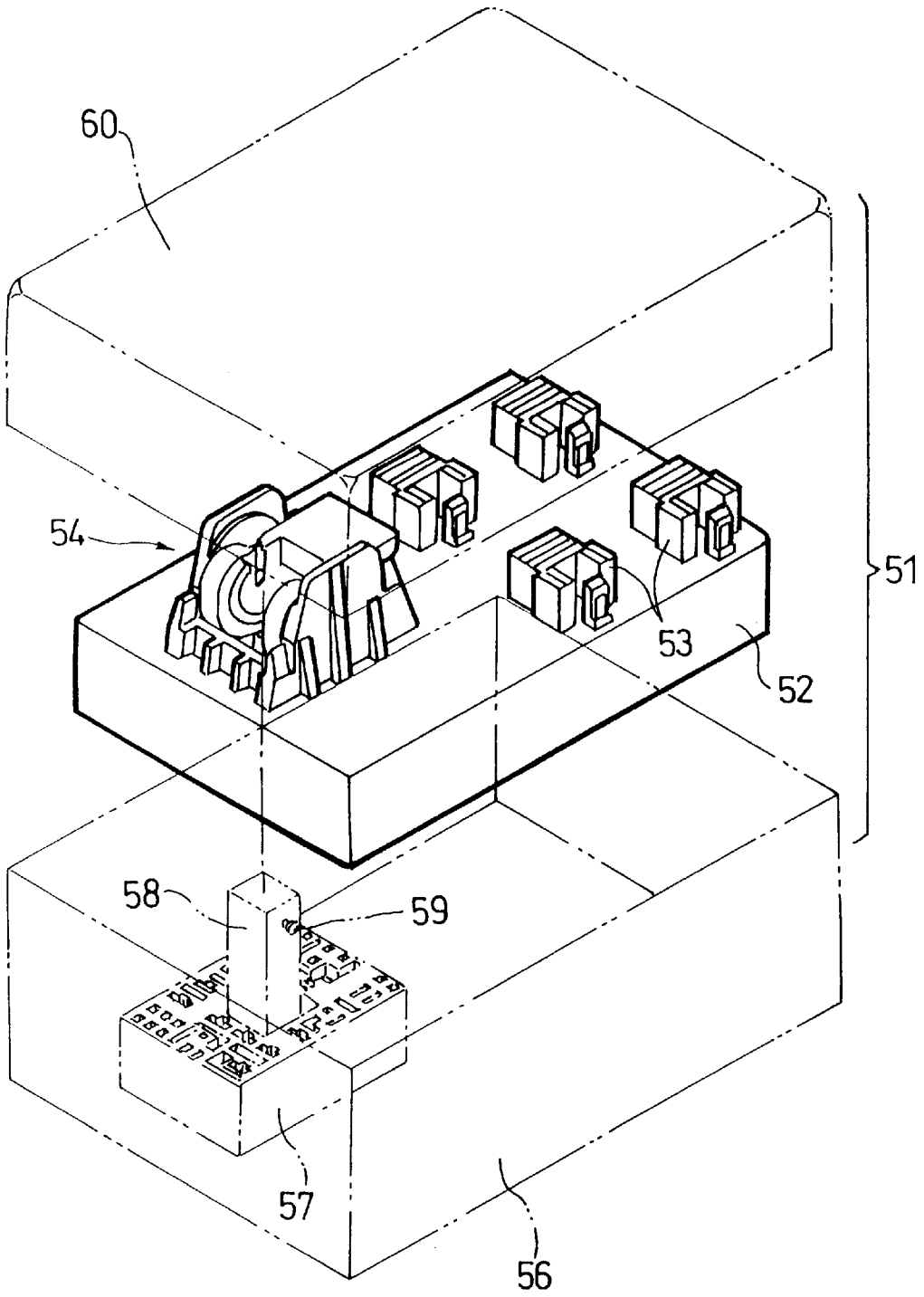
FIG. 1 is an exploded, perspective view of a first conventional electric connection box.
Figure 2:
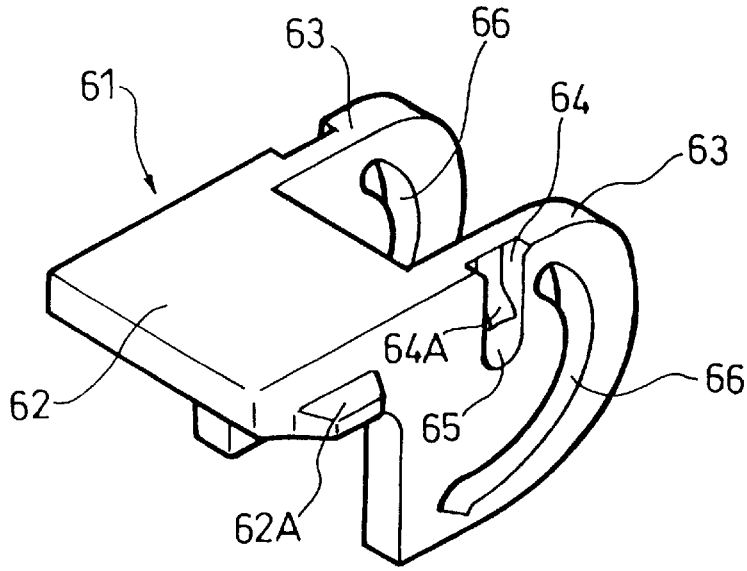
FIG. 2 is a perspective view showing the construction of a conventional lever member.
Figure 3:
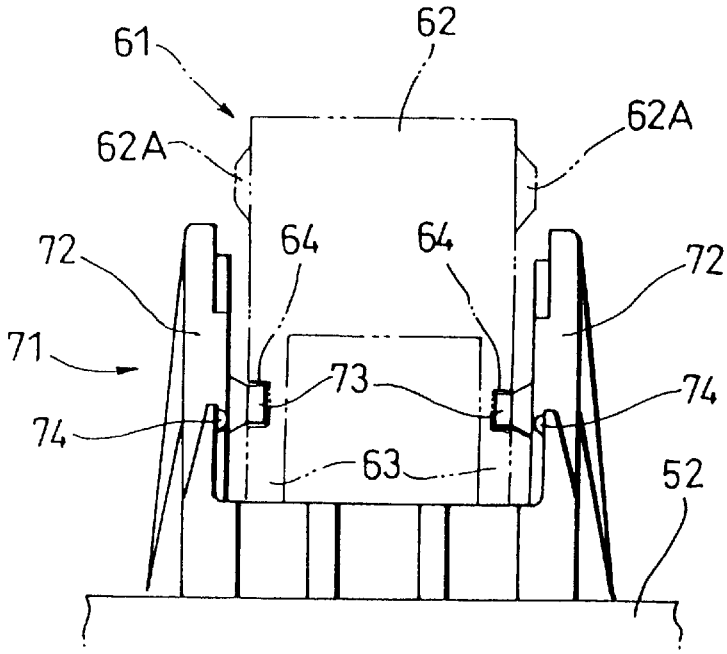
FIG. 3 is a side-elevational view showing the construction of a conventional lever support portion.
Figure 4:
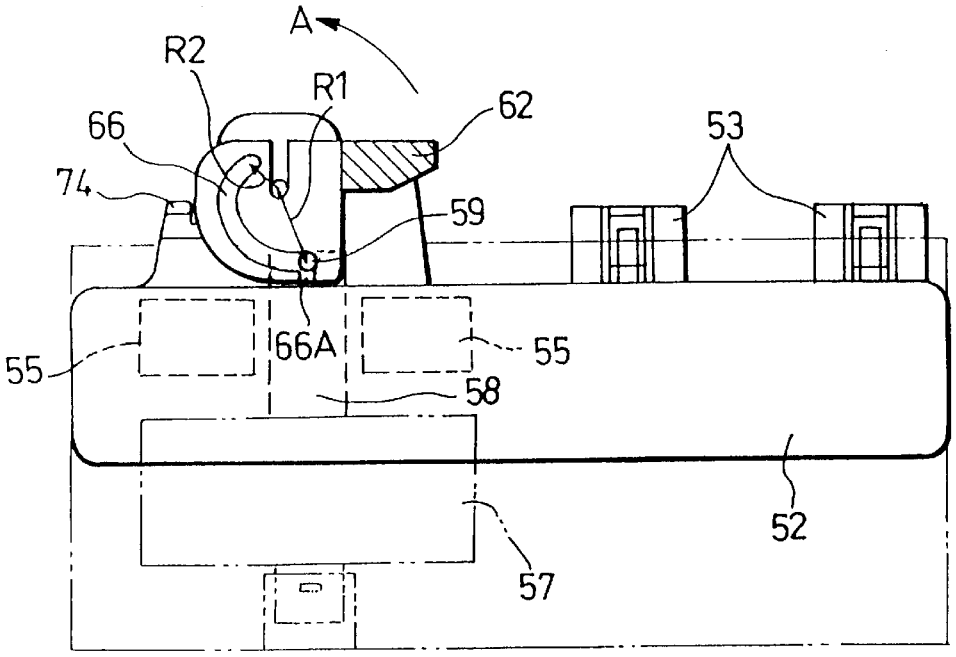
FIG. 4 is a schematic, side-elevational view showing a connector-connecting operation in the conventional electric connection box.
Figure 5:
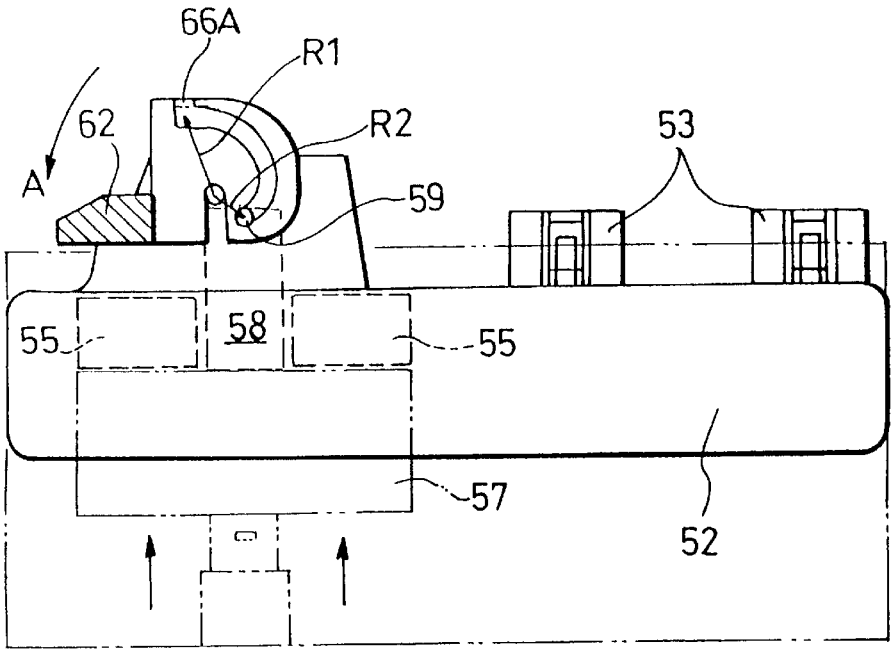
FIG. 5 is a schematic, side-elevational view showing a condition in which connectors in the conventional electric connection box are connected.
Figure 6:
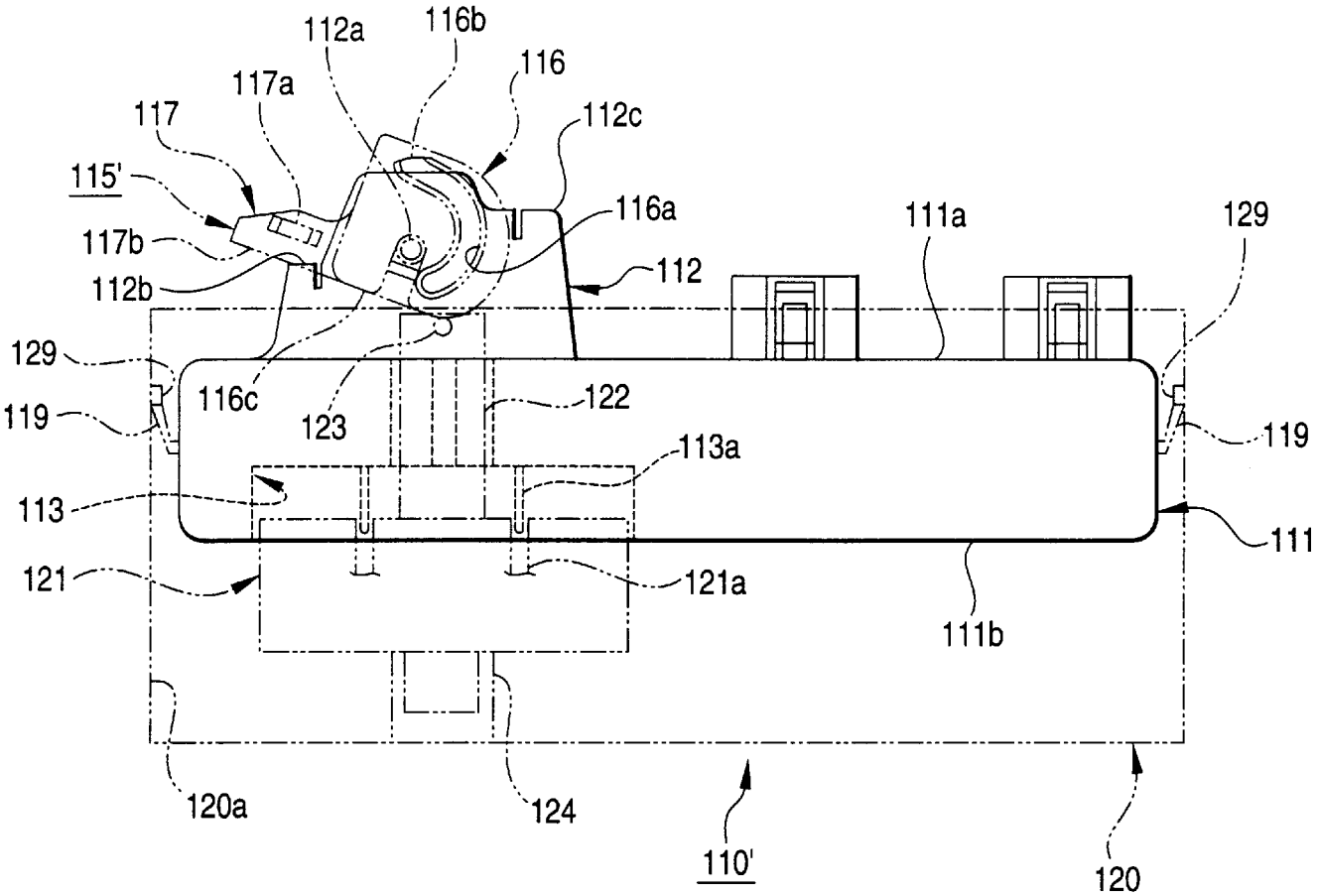
FIG. 6 is a view of the second conventional electric connection box, showing a condition in which a lever member is not engaged with guide pins.
Figure 7:
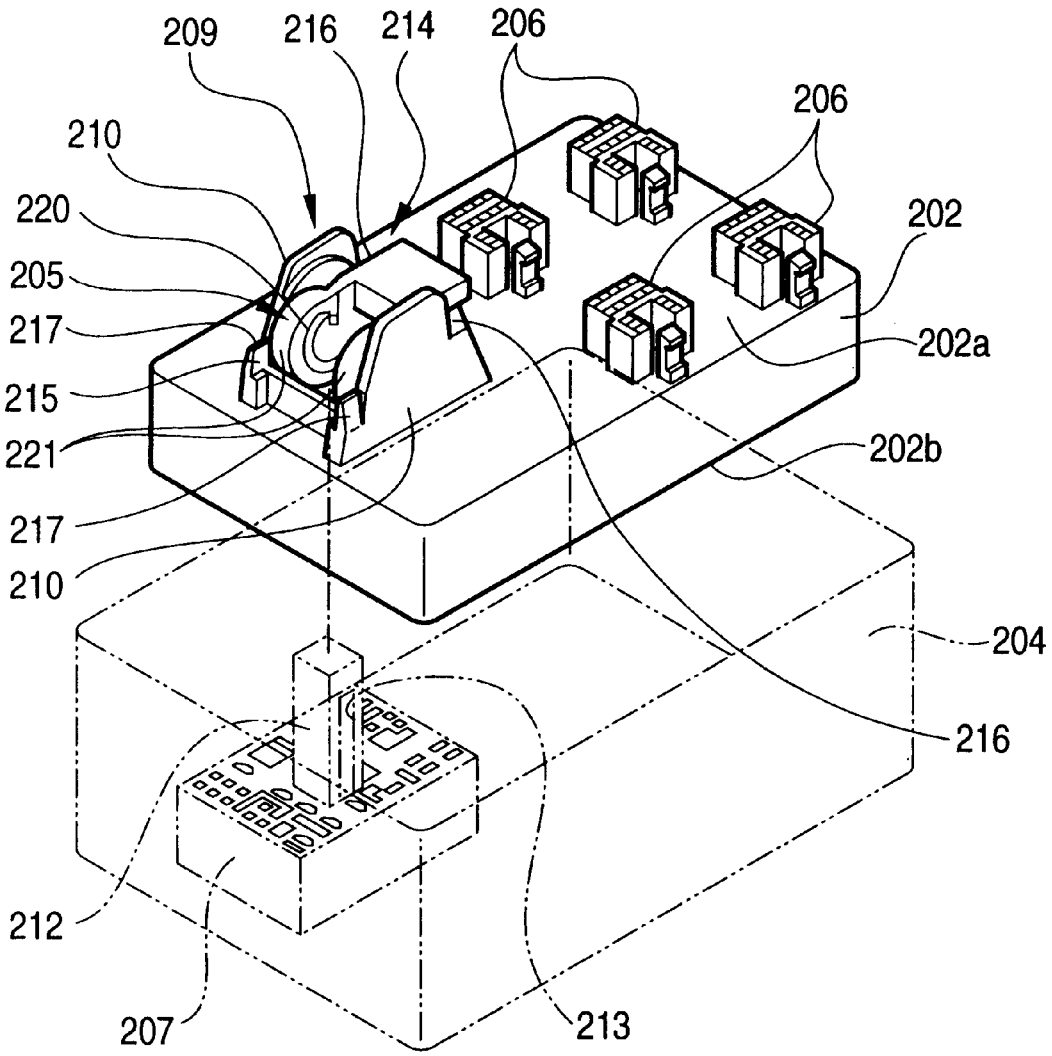
FIG. 7 is an exploded, perspective view of an electric connection box including a third conventional structure of fitting a connector into the electric connection box.
Figure 8:
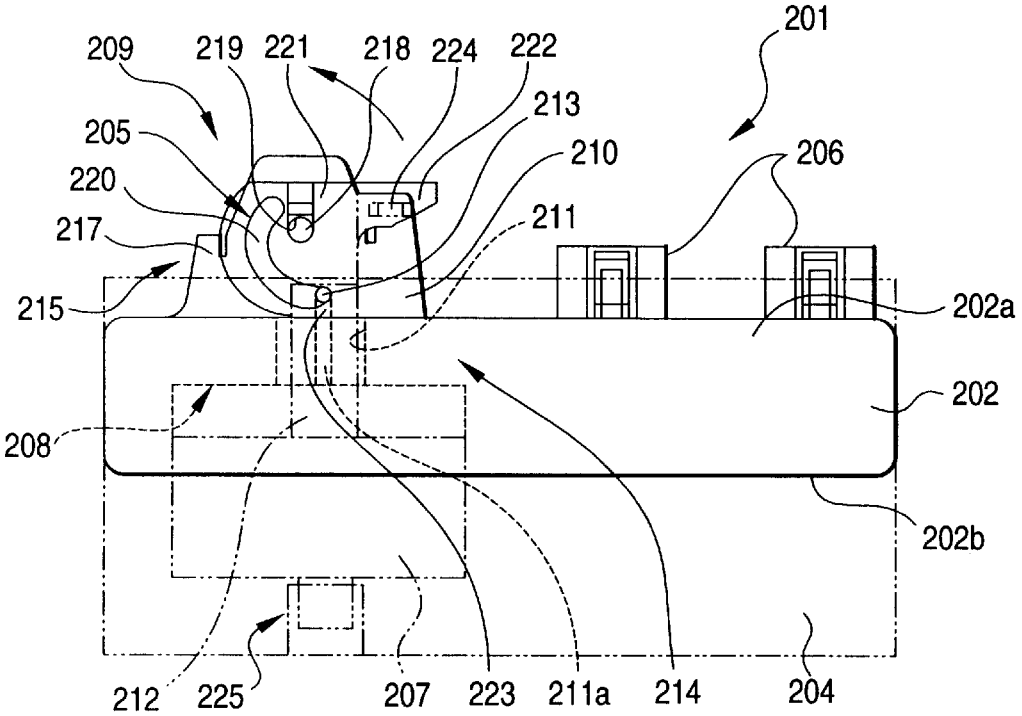
FIG. 8 is a view explanatory of a condition in which a lever member is retained on a provisionally-retaining portion in the conventional structure of fitting the connector into the electric connection box.
Figure 9:
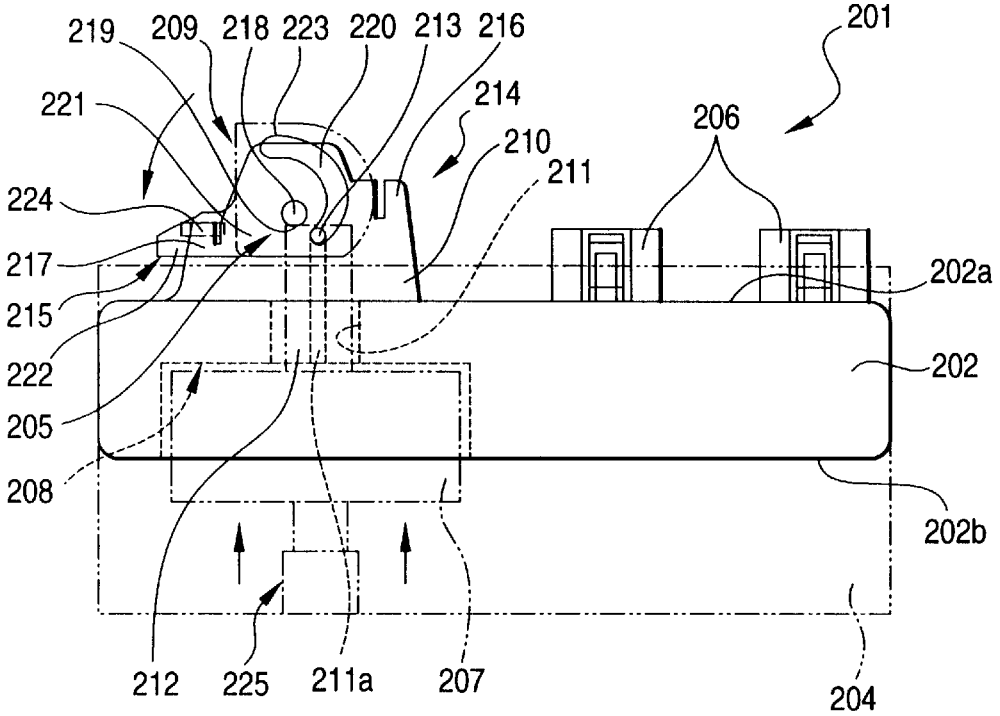
FIG. 9 is a view explanatory of a condition in which the lever member is retained on a completely-retaining portion in the conventional structure of fitting the connector into the electric connection box.
Figure 10:
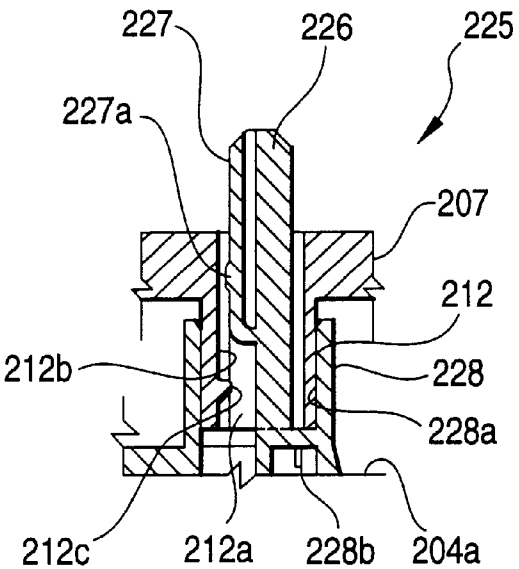
FIG. 10 shows a conventional connector retaining portion and a mating connector to be retained on this connector retaining portion, FIG. 10(*a*) being a cross-sectional view showing a condition before this retaining operation is effected, and FIG. 10(*b*) being a cross-sectional view showing the retained condition.
Figure 10:
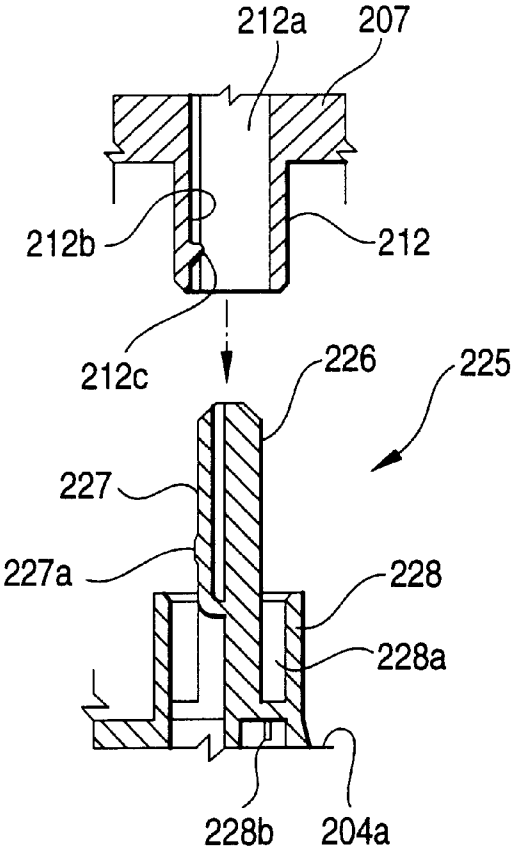
Figure 11:
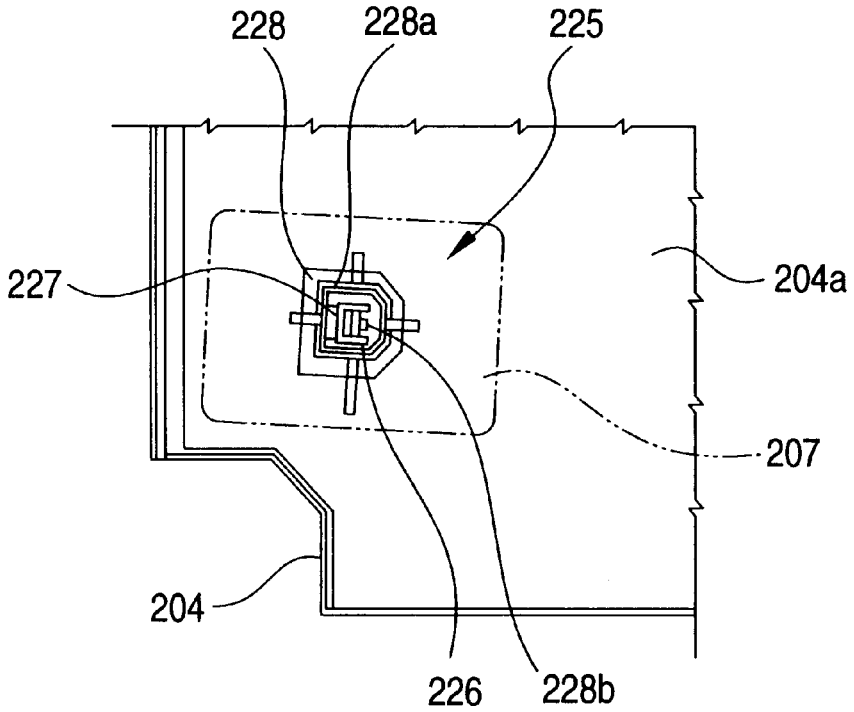
FIG. 11 is a plan view showing a condition in which the conventional connector retaining portion is displaced out of position.
Figure 12:
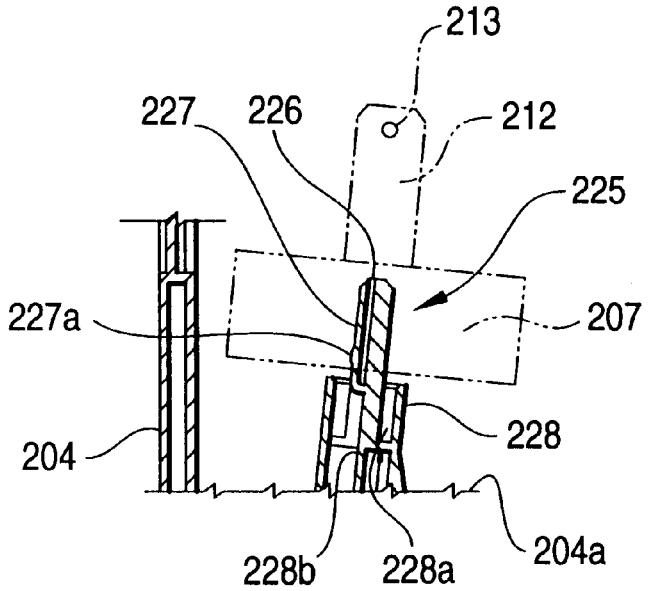
FIG. 12 is a plan view showing a condition in which the conventional connector retaining portion is tilted.
Figure 13:
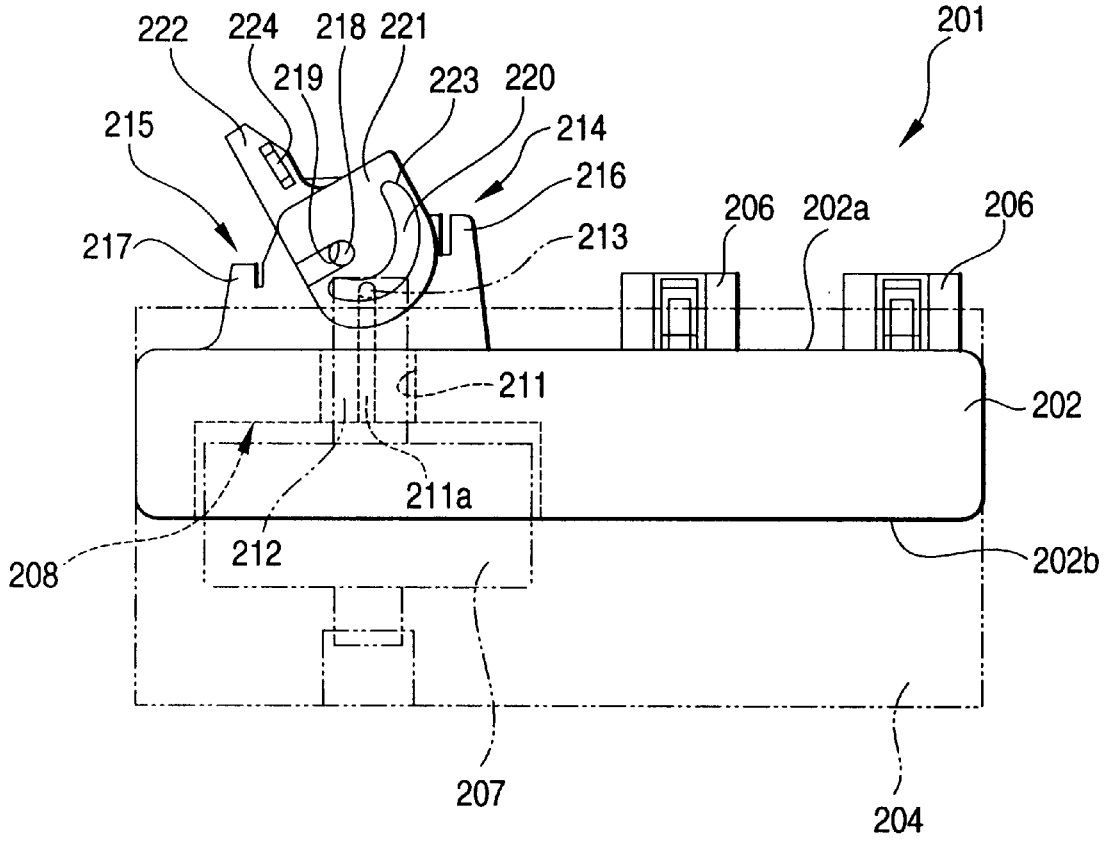
FIG. 13 is a view showing a condition in which the lever member is pivotally moved in the third conventional structure of fitting the connector into the electric connection box.
Figure 33:
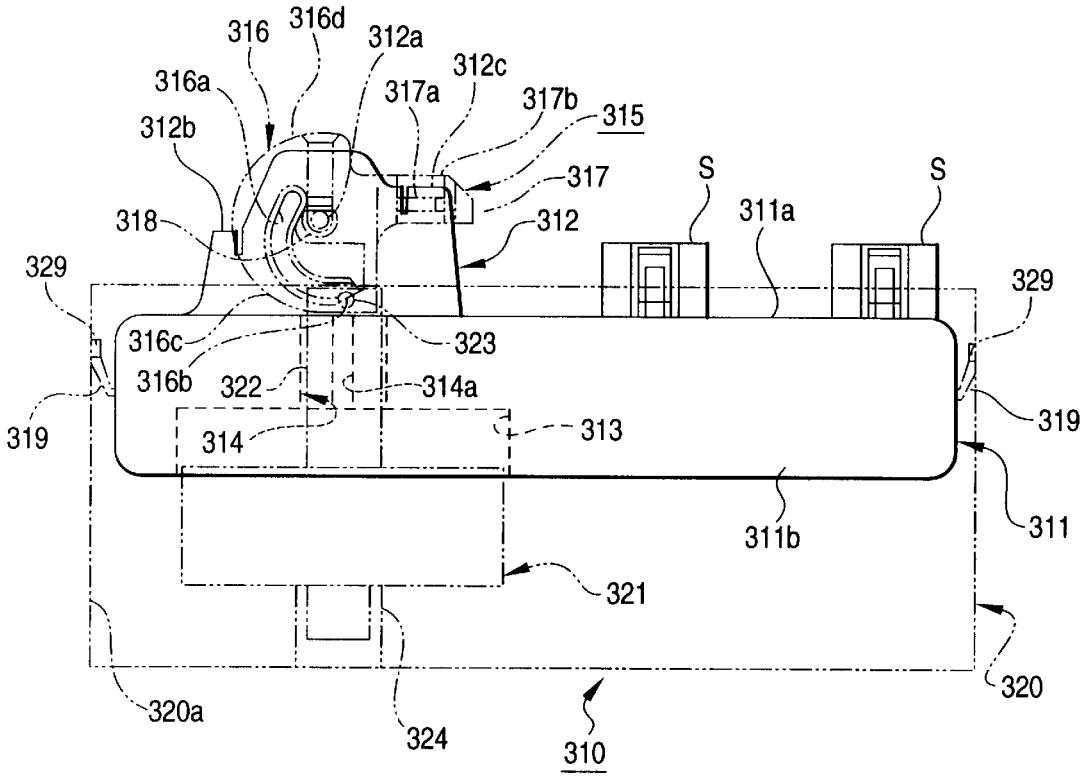
FIG. 33(*a*) is a view of third embodiment of an electric connection box of the present invention, showing a provisionally-retained condition of a lever member, and FIG. 33(*b*) is a perspective view of the lever member as seen from a reverse side thereof.
Figure 33:
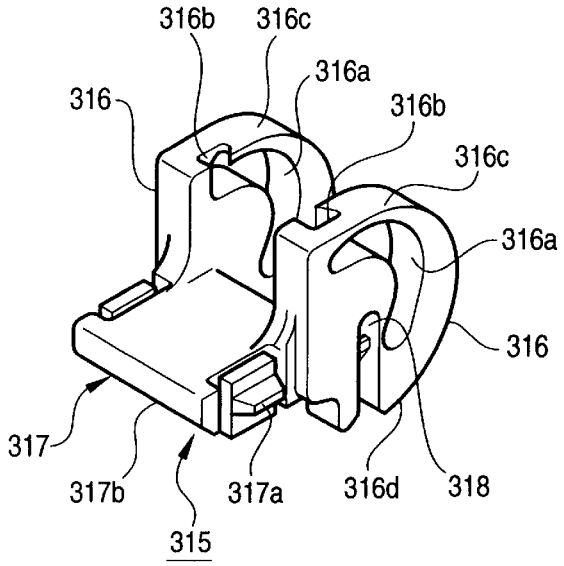
Figure 34:
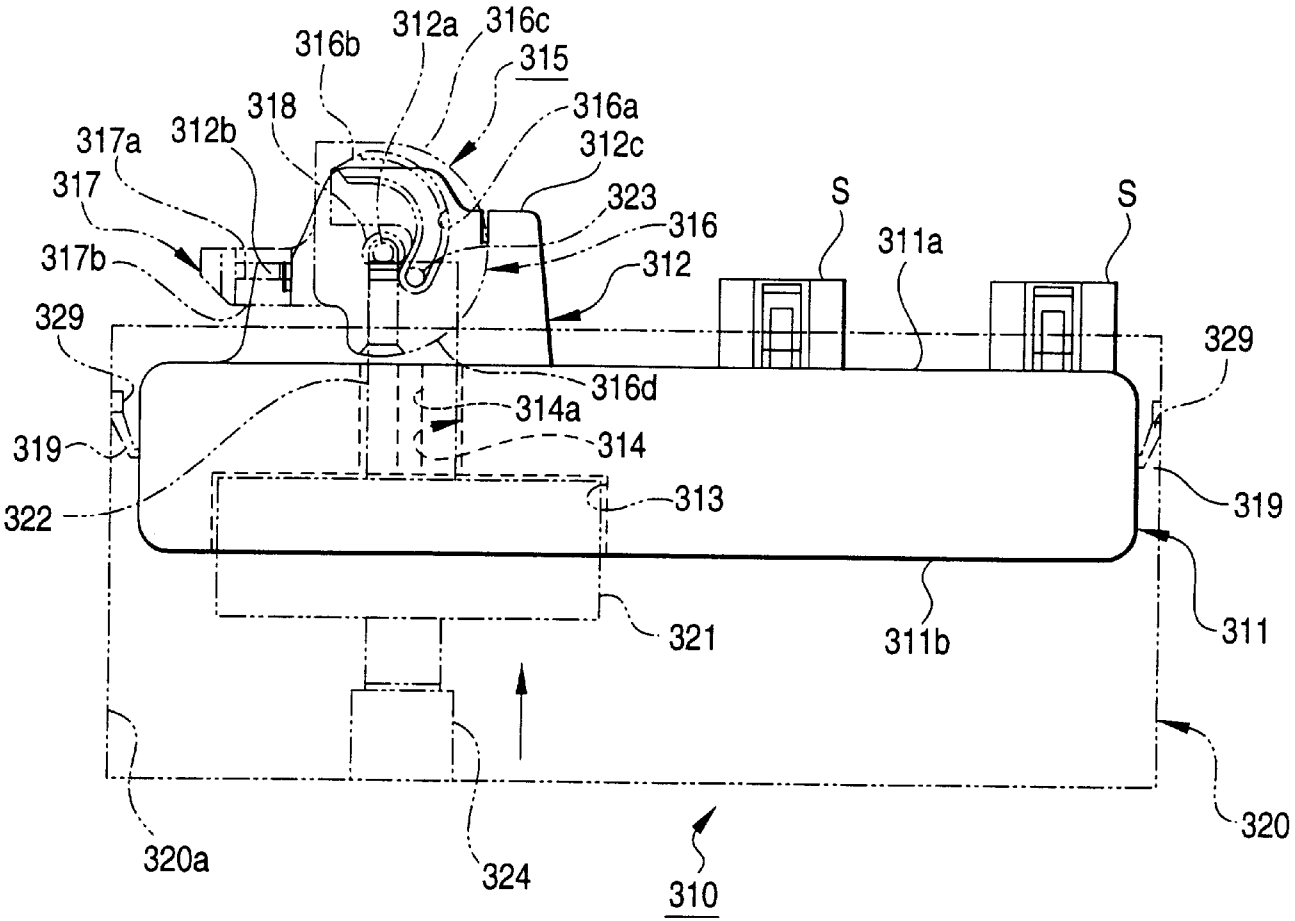
FIG. 34 is a view of the electric connection box, showing a completely-fitted condition of the lever member.
Figure 35:
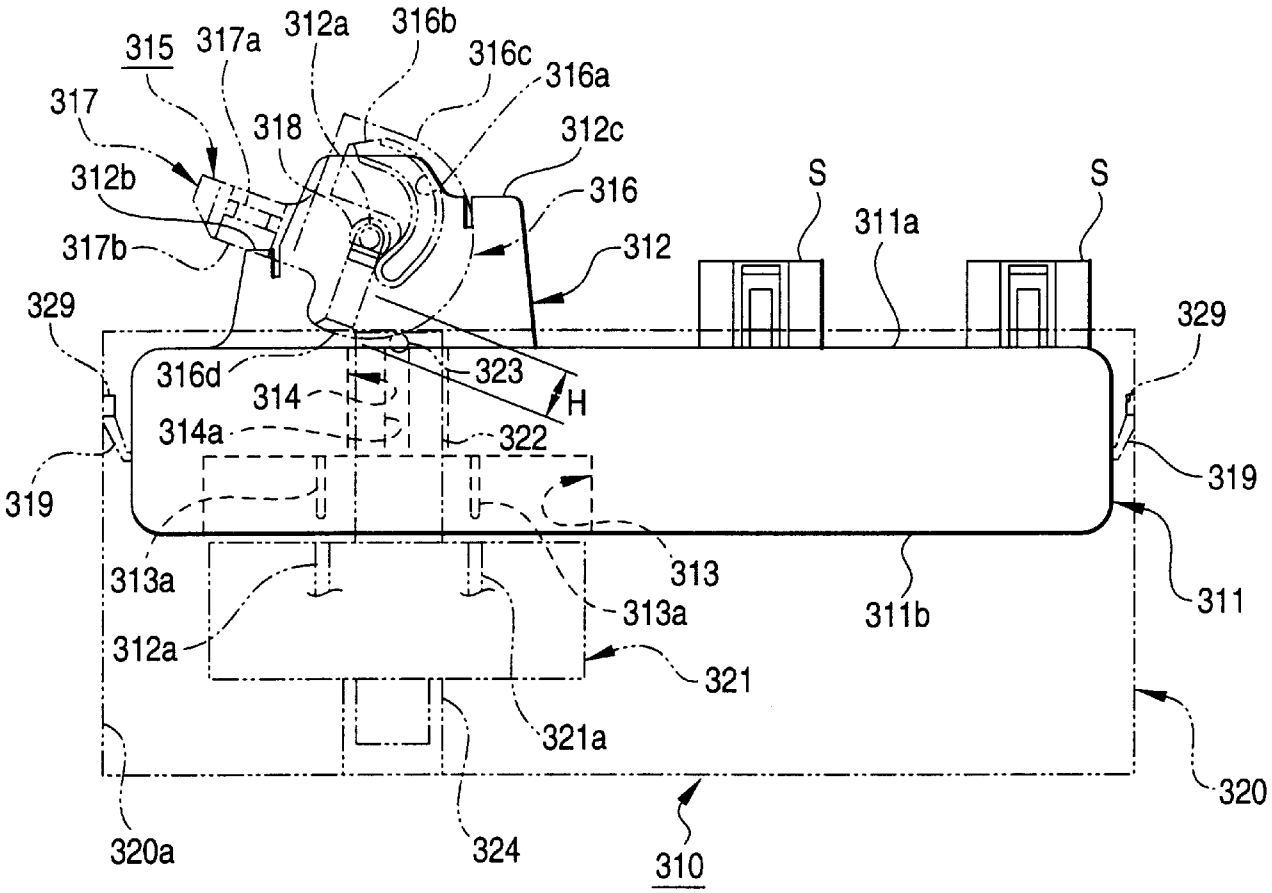
FIG. 35 is a view of the electric connection box, showing a condition in which the lever member is not engaged with guide pins.

FIG. 33(*a*) is a view of a third embodiment of an electric connection box of the present invention for mounting on a car body of an automobile, showing a provisionally-retained condition of a lever member, FIG. 33(*b*) is a perspective view of the lever member as seen from a reverse side thereof, FIG. 34 is a view of the electric connection box, showing a completely-fitted condition of the lever member, and FIG. 35 is a view of the electric connection box, showing a condition in which the lever member is not engaged with guide pins. The upper cover 60, shown in FIG. 1, will be used in the description of this embodiment.

As shown in FIGS. 33(*b*), 34 and 35, the electric connection box 310 comprises a connection box body 311 of a synthetic resin, which has the lever member 315 pivotally supported on an upper surface 311*a* thereof through support shafts 312*a* of a pair of lever support portions 312 and 312, and has a recessed connector portion 313 provided at a lower side 311*b* thereof, a lower cover 320 of a synthetic resin, which fully receives the connection box body 311 at an upper portion of an internal space 320*a* thereof in a manner to cover the lower side 311*b* of the connection box body 311, and has a mating connector 321 provided within the internal space 320*a* for upward and downward movement through a guide post 322 of the mating connector 321, and an upper cover 330 of a synthetic resin which covers the upper surface 311*a* of the connection box body 311.

The pair of lever support portions 312 and 312 are integrally formed upright on the upper surface 311*a* of the connection box body 311. The support shafts 312*a* of a cylindrical shape are formed respectively on opposed inner surfaces of the two lever support portions 312 and 312, and are disposed horizontally. A guide through hole 314 of a square tubular shape is formed in that portion of the connection box body 311 disposed between the pair of lever support portions 312 and 312. The lever member 315 is pivotally supported between the pair of lever support portions 312 and 312 through the support shafts 312*a* so as to be pivotally moved in right and left directions (in the drawings), and is disposed above the guide through hole 314. A pair of guide grooves 314*a* and 314*a* for respectively guiding a pair of guide pins 323 and 323, formed respectively on opposite sides of an upper portion of a guide post 322, are formed respectively in those opposed inner surfaces of the guide through hole 314 disposed adjacent respectively to the pair of lever support portions 312.

The lever member 315 of a generally U-shape includes a rectangular plate-like operating portion 317, and a pair of cam side plates 316 and 316 integrally formed on and projecting respectively from opposite sides of a rear portion of the operating portion 317. Arcuate cam grooves 316*a* are formed respectively in opposed inner surfaces of the pair of cam side plates 316 and 316, and each cam groove 316*a* is eccentric with respect to a bearing hole 318 in which the associated support shaft 312*a* is received.

An introducing port 316*b* for introducing the guide pin 323 is formed at a proximal end of each guide groove 316*a*. That portion of an outer peripheral surface 316*c* of each cam side plate 316, which is disposed in opposite relation to the introducing port 316*b*, projects outwardly beyond an obverse surface 317*b* of the operating portion 317 of the lever member 315. More specifically, a projected portion 316*d* of a generally arcuate shape is integrally formed on that portion of the outer peripheral surface 316*c* of the cam side plate 316, disposed in opposite relation to the introducing port 316*b*, and projects to the vicinity of the upper surface 311*a* of the connection box body 311 (The amount of projecting of this projected portion 316*d* beyond the obverse surface 317*b* of the operating portion 317 of the lever member 315 is indicated by reference character H in FIG. 35).

When the pivotal movement of the lever member 315 in a connector-fitting direction (counterclockwise direction in the drawings) is finished as shown in FIG. 34, this lever member 315 is retained in a completely-retaining position through the engagement of a pair of retaining projections 317*a* and 317*a* (which are formed respectively on the opposite sides of the operating portion 317 of the lever member 315) with a pair of elastic retaining pawls 312*b* and 312*b* formed respectively at opposed one ends of the two lever support portions 312 and 312. Before this pivotal movement of the lever member 315 is effected, the lever member 315 is retained in a stand-by position (provisionally-retaining position) through the engagement of the two retaining projections 317*a* and 317*a* (formed on the operating portion 317 of the lever member 315) with elastic retaining pawls 312*c* and 312*c* formed respectively at the opposed other ends of the two lever support portions 312 and 312.

When the connection box body 311 is fitted into an upper portion of the lower cover 320 in the provisionally-retained condition of the lever member 315, each guide pin 323 on the guide post 322 is introduced into the associated introducing port 316*b* (formed in the inner surface of the cam side plate 316) communicating with the proximal end of the cam groove 316*a* in the associated cam side plate 316 of the lever member 315. When each guide pin 323 is introduced into the introducing port 316*b* of the associated cam groove 316*a*, the connection box body 311 and the lower cover 320 are locked to each other in a mutually-fitted condition through the retaining engagement of elastic retaining pawls (retaining means) 319 (which are formed on the connection box body 311) with retaining projections (retaining means) 329 formed on the lower cover 320. More specifically, there is provided the retaining means which locks the connection box body 311 and the lower cover 320 to each other in a mutually-fitted condition only when the lever member 315 is in the provisionally-retaining position where each guide pin 323 on the guide post 322 can be introduced into the introducing port 316*b* of the cam groove 316*a* in the associated cam side plate 316, and this retaining means comprises the elastic retaining pawls 319 of a generally V-shape, integrally formed on and projecting respectively from the predetermined portions of the outer peripheral surface of the connection box body 311, and the block-like retaining projections 329 integrally formed on and projecting respectively from those portions of the inner surface of the internal space 320*a* of the lower cover 320 which are to be opposed respectively to the above predetermined portions of the connection box body 311. Reference character S in the drawings denotes an electric part-mounting portion to which an electric part, such as a relay, can be attached.

The guide post 322 of a square tubular shape is integrally formed on and projects from the mating connector 321, and extends in a vertical direction at generally central portions of upper and lower surfaces of the mating connector 321. The pair of guide pins 323 and 323 are integrally formed on and project from the opposite sides of the upper portion of the guide post 322, respectively.

The pair of guide pins 323 and 323 can be inserted and engaged respectively in the pair of cam grooves 316*a* and 316*a*, formed respectively in the pair of cam side plates 316 and 316 of the lever member 315, through the respective guide grooves 314*a* and 314*a* formed in the inner surface of the guide through hole 314 in the connection box body 311. The lower end portion of the guide post 322 is slidably received in a connector placing portion 324 of a rectangular tubular shape, integrally formed on and projecting from the bottom of the lower cover 320, in such a manner that the guide post 322 is prevented from withdrawal from the connector placing portion 324.

In the electric connection box 310 of this embodiment, when the connection box body 11 is fitted into the upper portion of the lower cover 320, with the lever member 315 disposed in the proper stand-by position (provisionally-retaining position) as shown in FIG. 33(*a*), the elastic retaining pawls 319 of the connection box body 311 are retainingly engaged respectively with the retaining projections 329 of the lower cover 320, thereby locking the connection box body 311 and the lower cover 320 to each other in a mutually-fitted condition. At this time, each guide pin 323 on the guide post 322 of the mating connector 321 is introduced into the associated cam groove 316*a* through the introducing port 316*b* in the associated cam side plate 316 of the lever member 315. In this condition, when the lever member 315 is pivotally moved through an angle of 1800 in one direction (counterclockwise direction) as shown in FIG. 34, each guide pin 323 on the guide post 322 is guided and moved toward the support shaft 312*a* along the cam groove 316*a* in the associated cam side plate 316 of the lever member 315, so that the mating connector 321, beforehand set on the connector placing portion 324 within the lower cover 320, is moved upward, and is positively fitted into the connector portion 313 of the connection box body 311.

When the connection box body 311 is fitted into the upper portion of the lower cover 320, with the lever member 315 disposed out of the proper stand-by position as shown in FIG. 35, the projected portion 316*d*, formed on that portion of the outer peripheral surface 316*c* of each cam side plate 316 disposed in opposite relation to the introducing port 316*b*, interferes with the associated guide pin 323 on the guide post 322 of the mating connector 321, and therefore the elastic retaining pawls 319 of the connection box body 311 are not brought into retaining engagement with the retaining projections 329 of the lower cover 320, and therefore the connection box body 311 and the lower cover 320 will not be locked together in a mutually-fitted condition.

Therefore, the operator can easily confirm the fact that the lever member 315 is not disposed in the proper stand-by position, and therefore the lever member 315 can be easily returned to the proper stand-by position without canceling the mutually-locked condition of the connection box body 311 and the lower cover 320. As a result, each guide pin 323 on the guide post 322 of the mating connector 321 is properly introduced into the cam groove 316*a* in the associated cam side plate 316 through the introducing port 316*b*, and the mating connector 321 in the lower cover 320 can be positively fitted into the connector portion 313 of the connection box body 311, thereby preventing the incomplete fitting engagement of the mating connector 321 with the connector portion 313, thus positively preventing the incomplete contact between the terminals 313*a* of the connector portion 313 and the terminals 321*a* of the mating connector 321.

Thus, the elastic retaining pawls 319 are formed on and project respectively from the predetermined portions of the connection box body 311, and the retaining projections 329 are formed on and project respectively from those portions of the lower cover 320 which are to be opposed respectively to the above predetermined portions of the connection box body 311, and the elastic retaining pawls 319 and the retaining projections 329 cooperate with each other to lock the connection box body 311 and the lower cover 320 to each other in a mutually-fitted condition only when the lever member 315 is in the provisionally-retaining position where each guide pin 323 on the guide post 322 can be introduced into the introducing port 316*b* of the cam groove 316*a* in the associated cam side plate 316. And besides, the projected portion 316*d* is formed on that portion of the outer peripheral surface 316*c* of each cam side plate 316, disposed in opposite relation to the introducing port 316*b*, and outwardly projects a distance H from the obverse surface 317*b* of the operating portion 317 of the lever member 315, and therefore if the lever member 315 is not disposed in the proper stand-by position (provisionally-retaining position) when the connection box body 311 is to be fitted into the upper portion of the lower cover 320, this can be easily confirmed from the appearance of the electric connection box 310. Therefore, the mating connector 321 in the lower cover 320 is prevented from being incompletely fitted into the connector portion 313 of the connection box body 311, and therefore the contact between the terminals 313*a* and the terminals 321*a*, which would occur when the mating connector 321 in the lower cover 320 is incompletely fitted in the connector portion 313 of the connection box body 311, is positively prevented.

When the lever member 315 is not disposed in the proper stand-by position (provisionally-retaining position), the mutually-fitted condition of the connection box body 311 and the lower cover 320 will not be locked, and therefore there is no need to cancel the mutually-fitted condition of the connection box body 311 and the lower cover 320 by a special jig as used in the conventional construction, and the connection box body 311 and the lower cover 320 can be easily disconnected from each other, and the lever member 315 can be easily returned to the proper stand-by position. Therefore, the connection box body 311 is again fitted into the upper portion of the lower cover 320, and then the lever member 315 is pivotally moved, and by doing so, the mating connector 321 in the lower cover 320 can be easily and positively fitted into the connector portion 313 of the connection box body 311.

And besides, the projected portion 316*d*, integrally formed on that portion of the outer peripheral surface 316*c* of the cam side plate 316 disposed in opposite relation to the introducing port 316*b*, has a generally arcuate shape, and projects to the vicinity of the upper surface 311*a* of the connection box body 311. Therefore, with the simple construction in which the configuration of the outer peripheral surface 316*c* of the cam side plate 316 of the lever member 315 is changed without the need for changing the configuration of the connection box body 311, the incomplete fitting engagement of the mating connector 321 of the lower cover 320 with the connector portion 313 of the connection box body 311 can be easily confirmed, and the number of the component parts and the cost can be reduced.

In the above embodiment, the retaining means, formed on the connection box body and the lower cover, is not limited to the combination of the elastic retaining pawls and the retaining projections, and for example, a combination of retaining projections and retaining recesses can be used. Although the connection box body has the single connector portion whereas the single mating connector is provided within the lower cover, the present invention can be applied to an embodiment in which a plurality of connector portions and a plurality of mating connectors are provided.

Fourth Embodiment

A structure of fitting a connector into an electric connection box, embodying the present invention, will now be described with reference to the drawings. Those portions of the fourth embodiment, identical in construction to those of the fitting structure of FIGS. 7 to 12, will be designated by identical reference numerals, respectively, and description thereof will be omitted.

The electric connection box 231 of this embodiment comprises a connection box body 202, a lower cover 234, which covers a lower side of the connection box body 202, and has a connector retaining portion 225 (on which a mating connector 237 to be fitted into a connector portion 208 is retained) formed on a bottom surface 234*a* thereof, and a lever member 205 which is pivotally supported on support shafts 218 of a lever support portion 209, and can be pivotally moved to bring the mating connector 237 into and out of fitting engagement with the connector portion 208.

In this embodiment, guide means 254 for guiding the mating connector 237, which is to be retained on the connector retaining portion 225, into a proper fitting position relative to the connector portion 208, is provided on a side wall 234*b* of the lower cover 234.

Figure 37:
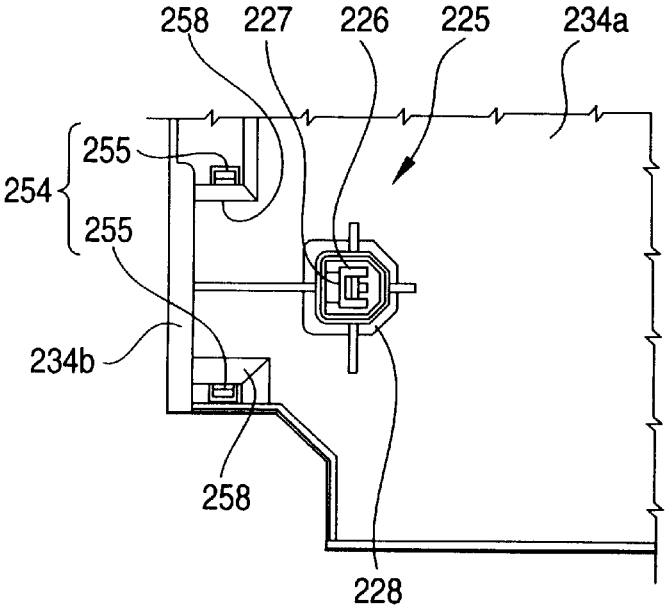
FIG. 37 shows the retaining portion of the lower cover and the mating connector to be retained on this lower cover in the structure of fitting the connector into the electric connection box, embodying the present invention, FIG. 37(*a*) being a plan view showing the connector retaining portion, and FIG. 37(*b*) being a plan view showing the mating connector.
Figure 37:
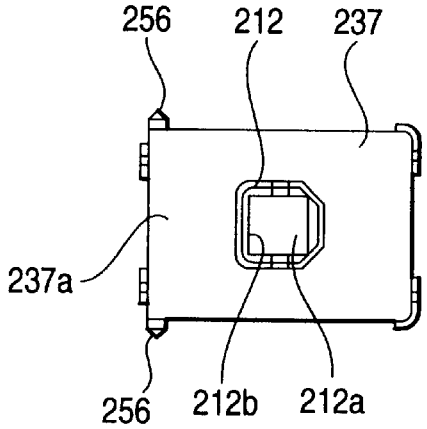
Figure 38:
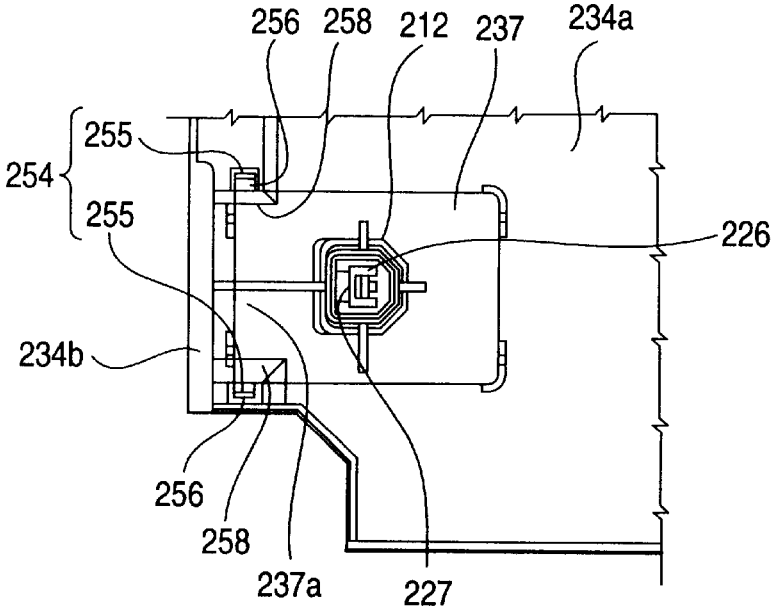
FIG. 38 is a plan view showing a condition in which the mating connector is retained on the retaining portion on the lower cover in the structure of fitting the connector into the electric connection box, embodying the present invention.

The guide means 254 comprises a pair of guide rails 255 and 255 which are formed on the side wall 234*b* of the lower cover 234 so as to hold and guide one end portion 237*a* of the mating connector 237. As shown in FIGS. 37 and 38, the guide rails 255 and 255 are formed respectively on a pair of support walls 258 and 258 projecting from the side wall 234*b*, and grooves are formed respectively in opposed surfaces of the guide rails 255. The one end portion 237*a* of the mating connector 237 is held between and guided by the guide rails 255 and 255.

Guide ribs 256 and 256 are formed on and project from opposite sides of the one end portion 237*a* of the mating connector 237, respectively. As shown in FIG. 38, the guide ribs 256 and 256 are fitted respectively into the grooves formed respectively in the guide rails 255 and 255.

Figure 36:
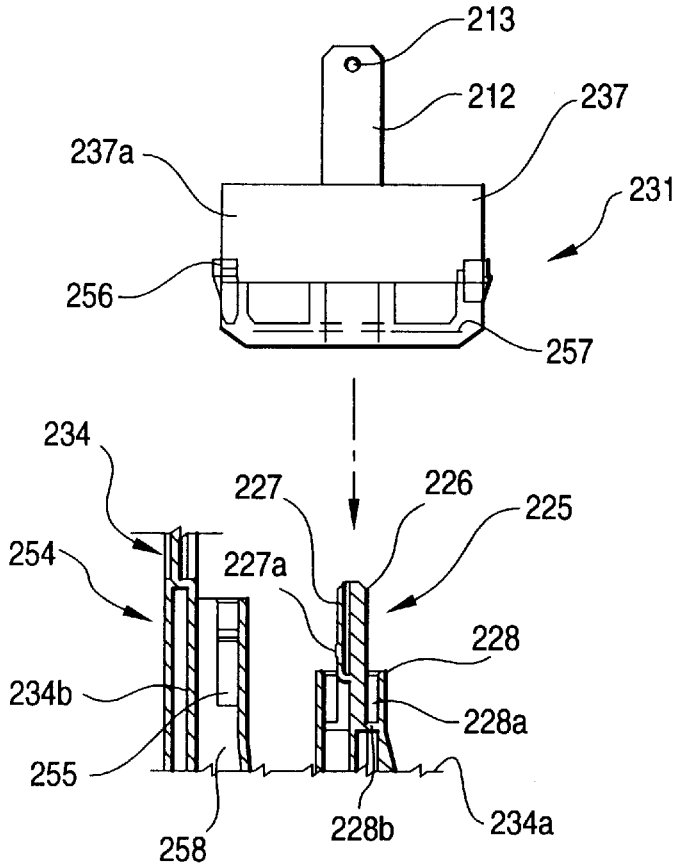
FIG. 36 shows a retaining portion of a lower cover and a mating connector to be retained on this lower cover in a structure of fitting a connector into an electric connection box, of fourth embodiment of the present invention, FIG. 36(*a*) being a cross-sectional view showing a condition before the mating connector is retained on the connector retaining portion, and FIG. 36(*b*) being a cross-sectional view showing a condition after the mating connector is retained on the connector retaining portion.
Figure 36:
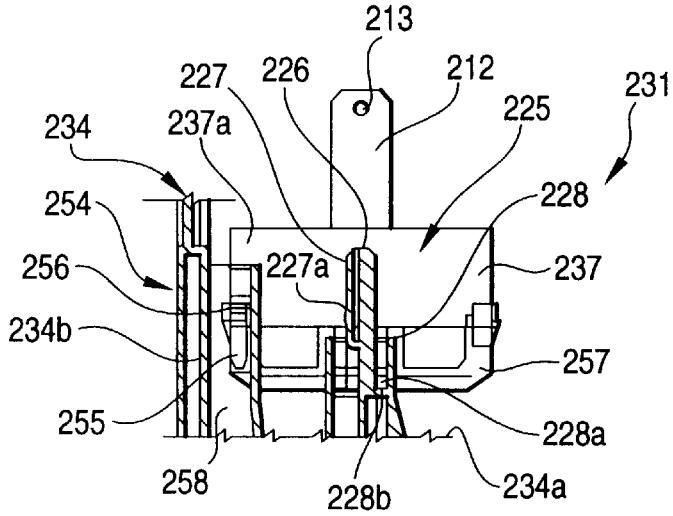

Reference numeral 57 in FIGS. 36(*a*) and 36(*b*) denotes a cover which protects a wire lead-out side of the mating connector 237.

For setting the mating connector 237 on the connector retaining portion 225 on the lower cover 234, the mating connector 237 is located above the connector retaining portion 225 as shown in FIG. 36(*a*), and then the mating connector 237 is moved toward the bottom surface 234*a* of the lower cover 234, and the guide ribs 256 and 256 are inserted respectively into the grooves formed respectively in the guide rails 255 and 255. In this condition, the mating connector 237 is moved toward the bottom surface 234*a*, so that a retaining post 226 is inserted into an internal space 212*a* in a guide post 212 while the guide post 212 is inserted into an internal space 228*a* defined by a placing wall 228. Thus, the mating connector 237 is set on the lower cover 234.

Figure 39:
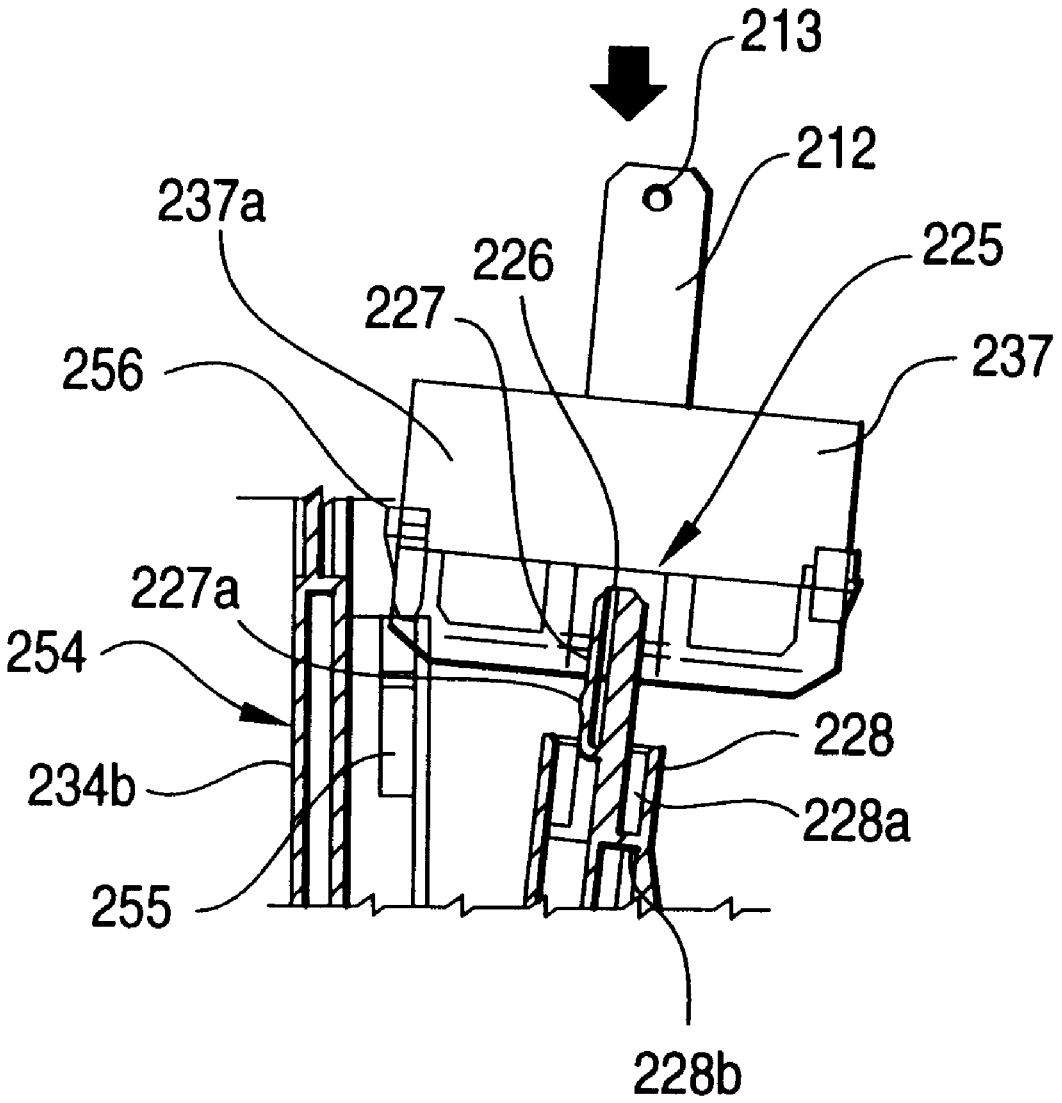
FIG. 39 is a plan view showing a condition in which the mating connector is to be retained on the connector retaining portion tilted as a result of deformation of a bottom surface of the lower cover.

In this case, even if the connector retaining portion 225 is tilted, for example, as a result of deformation of the bottom surface 234*a* as shown in FIG. 39, the mating connector 237 is positioned or set in the proper fitting position relative to the connector portion 208 when the one end portion 237*a* of the mating connector 237 is guided by the guide means 254. Therefore, the mating connector 237 can be positively fitted into the connector portion 208 by pivotally moving the lever member 205.

In this embodiment, although the ribs 256 and 256 are formed on the one end portion 237*a* of the mating connector 237, the provision of these ribs may be omitted, in which case the one end portion 237*a* is held between and guided by the guide rails 255 and 255.

Fifth Embodiment

A structure of fitting a connector into an electric connection box, embodying the present invention, will now be described with reference to the drawings. Those portions of this embodiment, identical in construction to those of the fitting structure of FIGS. 7 to 12, will be designated by identical reference numerals, respectively, and description thereof will be omitted.

The electric connection box 231 of fifth embodiment comprises a connection box body 232, an upper cover (not shown) which covers an upper surface 232*a* of the connection box body 232, a lower cover 234 which covers a lower side 232*b* of the connection box body 232. In the connector fitting structure of this embodiment, a plurality of electric part-mounting portions 236, to which electric parts (not shown) are adapted to be attached, are formed on and project from the upper surface 232*a* of the connection box body 232, and a side wall 232*c* is formed on and projects from the upper surface 232*a*. A connector portion 208 is provided in the lower surface 232*b*. A lever member 235 is pivotally mounted on a lever support portion 239 on the connection box body 232, and by pivotally moving the lever member 235, a mating connector 207 can be fitted into and disconnected from the connector portion 208.

In this embodiment, the lever member 235 is supported on the lever support portion 239 in such a manner that when the mating connector 207 is completely fitted in the connector portion 028, a height H1 of the lever member 235 from the upper surface 232*a* is equal to at least one of a height H2 of the electric part-mounting portions 236 from the upper surface 232*a*, a height H2 of the side wall 232*c* from the upper surface 232*a* and a height H2 of a distal end 212*a* of a guide post 212 of the mating connector 207. In this embodiment, the height of the electric part-mounting portions 206, the height of the side wall 232*c* and the height of the distal end 212*a* of the guide post 212 are equal to each other.

The lever support portion 239 includes a pair of lever support walls 240 and 240, and support shafts 248 formed on and projecting from opposed surfaces of the lever support walls 240 and 240, respectively. A provisionally-retaining portion 214 is provided at one ends of the lever support walls 240 and 240 close to the electric part-mounting portions 236, and a completely-retaining portion 215 is provided at the other ends of the lever support walls 240 and 240 remote from the electric part-mounting portions 236.

Figure 40:
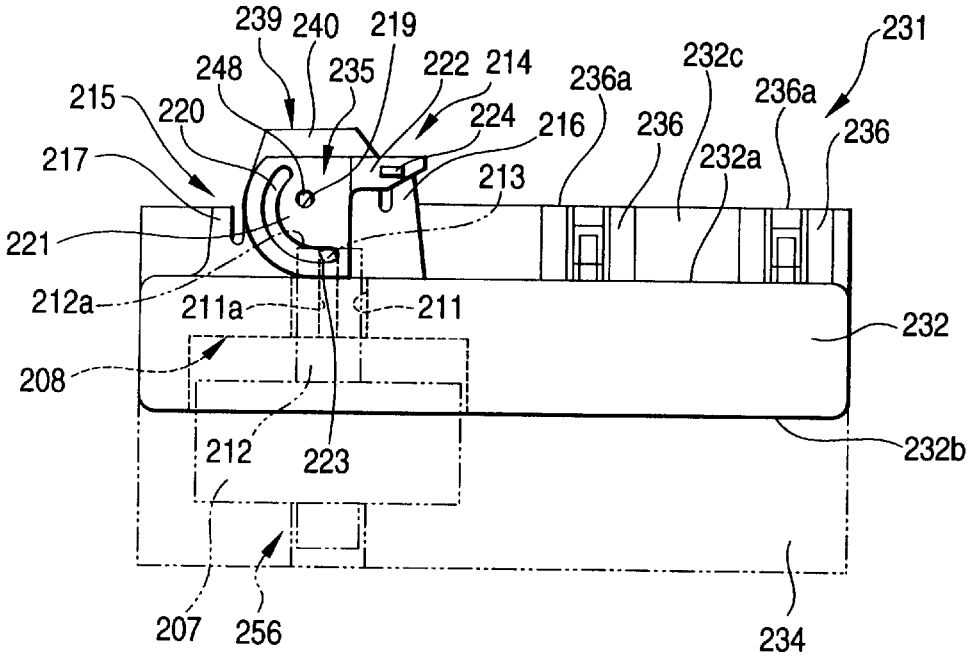
FIG. 40 shows an electric connection box employing a structure of fitting a connector into the electric connection box in a fifth embodiment of the present invention, FIG. 40(*a*) being a view showing a condition in which a lever member is provisionally retained on a provisionally-retaining portion, and FIG. 40(*b*) being a view showing a condition in which the lever member is completely retained on a completely-retaining portion.
Figure 40:
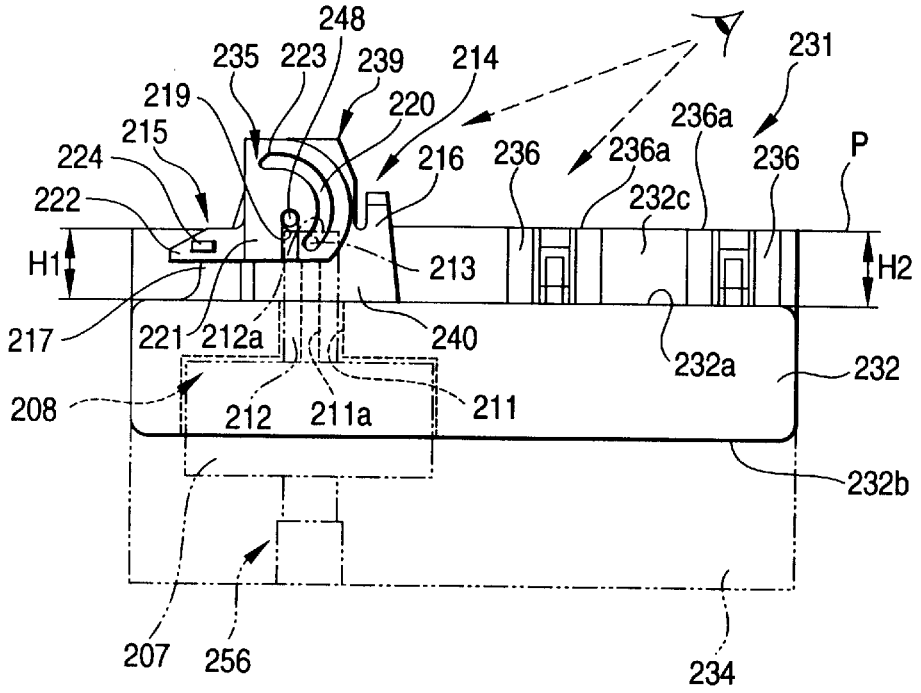

For fitting the mating connector 207 into the connector portion 208 of the connection box body 232, the lever member 235 is first retainingly engaged with the provisionally-retaining portion 214, so that introducing ports 223 are disposed in registry with a guide through hole 211, as shown in FIG. 40(*a*). Then, the lower side 232*b* of the connection box body 232 is covered with the lower cover 234 having the mating connector 207 beforehand retained on a connector retaining portion 256 of the lower cover 234. When the lower side of the connection box body 232 is thus covered with the lower cover 234, each of guide pins 213 on the mating connector 207 is introduced into an associated cam groove 220 through an associated introducing port 223. In this condition, when the lever member 235 is pivotally moved about the support shafts 248 in a counterclockwise direction (FIG. 40(*a*)), the guide pins 213 are moved relative to the cam grooves 220, respectively, and hence are moved toward the support shafts 248, respectively. In accordance with this movement, the mating connector 207 is moved toward the connector portion 208.

When the lever member 235 is retainingly engaged with the completely-retaining portion 215, the mating connector 207 is fitted into the connector portion 208 as shown in FIG. 40(*b*). In this condition, the height Hi of an operating portion 222 from the upper surface 232*a* of the connection box body 232 is equal to the height H2 of end surfaces 236*a* of the electric part-mounting portions 236 from the upper surface 232*a*, the height H2 of an end surface (upper surface) of the sidewall 232*c* from theupper surface 232*a* and the height H2 of the distal end 212*a* of the guide post 212 of the mating connector 207, and therefore the end surfaces 236*a* of the plurality of electric part-mounting portions 236, the end surface of the side wall 232*c* and the distal end 212*a* of the guide post 212 of the mating connector 207 are disposed in a common plane P.

Therefore, when the mating connector 207 is completely fitted into the connector portion 208 by pivotally moving the lever member 235, the height H1 of the operating portion 222 of the lever member 235 from the upper surface 232*a* is equal to the height H1 of the electric part-mounting portions 236, the height H2 of the side wall 232*c* and the height H2 of the distal end 212*a* of the mating connector 207, and therefore it can be easily and positively confirmed with the eyes whether or not the lever member 235 has been properly operated.

If the lever member 235 is in a half-operated condition, that is, if the mating connector 207 is not completely fitted in the connector portion 208, the operating portion 222 of the lever member 35 is projected beyond the electric part-mounting portions 236, the side wall 232*c* and the distal end 212*a* of the guide post 212 in a direction away from the upper surface 232*a*, and therefore such an incompletely-fitted condition can be easily recognized by confirming the thus projected operating portion 222 with the eyes.

In this embodiment, since the height H1 of the operating portion 222 can be easily confirmed with the eyes, the mating connector 207 can be positively fitted into the mating connector 208, and the failure of contact between mating terminals of the mating connector 207 and terminals in the connector portion 208, as well as the incomplete contact therebetween, can be positively prevented.

When the mating connector 207 is completely fitted in the connector portion 208, the electric part-mounting portions 236, the end surface of the side wall 232*c* and the distal end 212*a* of the guide post 12 of the mating connector 207 will not project beyond the lever member 235, and therefore the operating portion 222 will not inadvertently be touched, and this eliminates a possibility that the completely-fitted condition is accidentally canceled.

And besides, since the operating portion 222 will not project beyond the electric part-mounting portions 236, the side wall 232*c* and the distal end 12*a* of the guide post 212, a space on the upper side 232*a* of the connection box body 232 can be efficiently used.

In the above embodiment, although the height Hi of the operating portion 222 from the upper surface 232*a* is equal to the height H2 of the electric part—mounting portions 236, the height H2 of the side wall 232*c* and the height H2 of the distal end 212*a* of the guide post 212, the overall height of the lever member 235 may be equal to the height of the electric part-mounting portions 236, the height of the side wall 232*c* and the height of the distal end 212*a* of the guide post 212.

In the above embodiment, although the electric part-mounting portions 236, the side wall 232*c* and the distal end 212*a* of the guide post 212 have the same height, and are equal in height to the operating portion 222 in the completely-fitted condition, the operating portion 222 may be equal in height to at least one of the electric part-mounting portions 236, the side wall 232*c* and the distal end 12*a* of the guide post 212.

As described above, in the lever structure of the present invention for the electric connection box, the retaining projections are elastically-deformably formed respectively on those portions of the opposite side surfaces of the operating portion (of the lever member) which can be opposed to the pair of support side plates (which pivotally supports the lever member), respectively. Therefore, the retaining projections can be elastically deformed without lowering the rigidity of the operating portion.

Therefore, by operating the rigid operating portion with a small force, the lever member can be brought into and out of retaining engagement with the retaining projections, formed respectively on one ends of the two support side plates, and therefore the operability of this operation is enhanced.

And besides, the sense of a click is obtained when the retaining engagement is effected and canceled, and therefore the retaining engagement and the cancellation of the retaining engagement can be confirmed. The lever member, the operating portion and the retaining projections are molded into an integral construction, using a synthetic resin, and therefore the product of high reliability can be provided at low costs.

In the lever structure of the present invention for the electric connection box, the operating portion, which has the retaining projections for fixing the lever member, and can be operated to pivotally move the lever member, has a hollow configuration. Therefore, the whole of the operating portion, including the retaining projections, can be elastically deformed without lowering the rigidity of the retaining projections. With this construction, the operating portion and the retaining projections have elasticity, and therefore the retaining projections can be positively brought into and out of retaining engagement with the associated retaining projections with a small force, and the operability and the efficiency of the operation can be enhanced. Therefore, the retaining projections, formed on the operating portion, can be brought into and out of retaining engagement with the associated retaining projections with a small resistance, while obtaining the sense of a click, and the efficiency of the operation and the reliability can be enhanced.

The retaining projections are formed respectively on the side surfaces of the pair of support side plates, and are retainingly engaged respectively with the retaining projections of the lever member to position the lever member when the connector-connecting operation is to be effected. Therefore, the position of the lever member can be easily fixed when effecting the connector-connecting operation, and the efficiency of the operation is enhanced.

The operating portion is formed into a hollow, rectangular parallelepiped shape, using the long plate portions and the short plate portions. Therefore, particularly, the long plate portions of the operating portion can be easily elastically deformed, and the retaining engagement of the retaining projections, as well as the cancellation of this retaining engagement, can be effected with a small force, and the efficiency of the operation is enhanced.

As described above, according to the present invention, there is provided the retaining means which locks the connection box body and the lower cover to each other in a mutually-fitted condition only when the lever member is in the provisionally-retaining position where each guide pin can be introduced into the introducing port of the cam groove, and the retaining means is provided on those portions of the connection box body and the lower cover to be opposed to each other, and the projected portion is formed on that portion of the outer peripheral surface of the cam side plate, disposed in opposite relation to the introducing port, and projects outwardly beyond the obverse surface of the operating portion of the lever member. Therefore, if the lever member is not disposed in the proper stand-by position (provisionally-retaining position) when the connection box body is to be attached to the lower cover, this can be easily confirmed. Therefore, the mating connector in the lower cover is prevented from being incompletely fitted into the connector portion of the connection box body, and therefore the contact between the terminals of the mating connector and the terminals of the connector portion, which would occur when the mating connector in the lower cover is incompletely fitted in the connector portion of the connection box body, is positively prevented.

And besides, when the lever member is not disposed in the proper stand-by position (provisionally-retaining position), the mutually-fitted condition of the connection box body and the lower cove will not be locked, and therefore there is no need to cancel the mutually-fitted condition of the connection box body and the lower cover, and the connection box body and the lower cover can be easily disconnected from each other, and the lever member can be easily returned to the proper stand-by position.

According to the present invention, the projected portion is formed integrally on the outer peripheral surface of the cam side plate, and has a generally arcuate shape, and projects to the vicinity of the upper surface of the connection box body. With this simple construction in which the configuration of the outer peripheral surface of the cam side plate of the lever member is changed without the need for changing the configuration of the connection box body, the incomplete fitting engagement of the mating connector of the lower cover with the connector portion of the connection box body can be easily confirmed, and the number of the component parts and the cost can be reduced.

As described above, in the present invention, even if the connector retaining portion is displaced out of position because of a warp of the bottom surface of the lower cover, the guide means guides the mating connector into the proper fitting position relative to the connector portion when retaining the mating connector on the connector retaining portion. Therefore, the mating connector can be positively fitted into the connector portion.

In the present invention, even if the connector retaining portion is displaced out of position because of a warp of the bottom surface of the lower cover, the mating connector is guided into the proper fitting position by the pair of guide rails, and therefore the connector retaining portion is corrected into its proper position through the mating connector, so that the mating connector can be properly fitted into the connector portion.

In the present invention, for retaining the mating connector on the connector retaining portion, the retaining post is inserted into the mating connector, so that the mating connector is placed on the placing wall. At the same time, the engagement arm is engaged with the mating connector. As a result, the mating connector is positively retained in the predetermined position on the lower cover.

In the present invention, when the mating connector is completely fitted into the connector portion, the height of the lever member from the upper surface is equal to at least one of the height of the electric part-mounting portions, the height of the sidewall and the height of the distal end of the mating connector, and therefore it can be easily and positively confirmed with the eyes whether or not the lever member has been properly operated.

If the mating connector is not completely fitted in the connector portion, the lever member is projected beyond the electric part-mounting portions, the side wall and the distal end of the mating connector in a direction away from the upper surface, and therefore such an incompletely-fitted condition can be easily recognized by confirming the thus projected lever member with the eyes.

In the present invention, when the mating connector is completely fitted in the connector portion, the height of the operating portion from the upper surface is equal to at least one of the height of the side wall, the height of the distal end of the mating connector and the height of the electric part-mounting portions. Therefore, it can be easily and positively confirmed whether or not the lever member has been properly operated.

If the operating portion is in a half-operated condition, that is, if the mating connector is not completely fitted in the connector portion, the operating portion is projected beyond the electric part-mounting portions, the side wall and the distal end of the mating connector in a direction away from the upper surface, and therefore the fact that the mating connector is not completely fitted in the connector portion can be easily recognized by confirming the thus projected operating portion with the eyes.

In the present invention, when the mating connector is completely fitted in the connector portion, the lever member is disposed in the plane in which the end surfaces of the electric part-mounting portions, the end surface of the side wall and the end surface of the distal end of the mating connector lie. Therefore, the completely-fitted condition can be easily and positively confirmed by confirming this condition with the eyes.

If the mating connector is incompletely fitted in the connector portion, the lever member is not disposed in the plane in which the plurality of electric part-mounting portions, the side wall and the distal end of the mating connector lie, but projects beyond this plane. Therefore, the fact that the mating connector is incompletely fitted in the connector portion can be easily confirmed by confirming the thus projected lever member with the eyes.

What is claimed is:

1. A lever structure of an electric connection box comprising:

a lever support portion, having a pair of support side plates, formed on an upper casing on which a connector is mounted;

a lever member pivotally supported on support shafts formed respectively on said support side plates, and said lever member being pivotally moved about said support shafts, so that guide pins, provided at a lower casing, are guided and moved upward and downward respectively by guide grooves, formed in said lever member, thereby connecting and disconnecting a connector, which is provided at said lower casing, and is movable upward and downward together with said guide pins, relative to said first-mentioned connector; and retaining projections, formed on an operating portion of said lever member, retainingly engaged respectively with retaining projections, formed respectively on said support side plates, in a connector-connecting position, said retaining projections elastically-deformably formed respectively on those portions of opposite side surfaces of said operating portion which can be opposed to said pair of support side plates, respectively.

2. A lever structure of an electric connection box comprising:

a lever support portion, having a pair of support side plates, formed on an upper casing on which a connector is mounted;

a lever member pivotally supported on support shafts formed respectively on said support side plates, and said lever member being pivotally moved about said support shafts, so that guide pins, provided at a lower casing, are guided and moved upward and downward respectively by guide grooves, formed in said lever member, thereby connecting and disconnecting a connector, which is provided at said lower casing, and is movable upward and downward together with said guide pins, relative to said first-mentioned connector, said operating portion of said lever member has a hollow configuration; and retaining projections, formed on an operating portion of said lever member, retainingly engaged respectively with retaining projections, formed respectively on said support side plates, in a connector-connecting position.

3. A lever structure according to claim 2, further comprising:

retaining projections formed respectively on side surfaces of said pair of support side plates, and said retaining projections are retainingly engaged respectively with said retaining projections of said lever member to position said lever member when the connector-connecting operation is to be effected.

4. A lever structure according to claim 2, wherein said operating portion is formed by long plate portions, which can be easily elastically deformed, and short plate portions which are less elastically deformable.

5. An electric connection box comprising:

a connection box body having a lever member pivotally supported on an upper surface thereof through support shafts of lever support portions, and having a connector portion provided at a lower side thereof;

a lower cover removably receiving said connection box body in a manner to cover the lower side of said connection box body, and having a mating connector movably provided within said lower cover;

each of guide pins, formed on said mating connector, introduced and engaged in a cam groove, formed in an associated cam side plate of said lever member, through a guide pin-introducing port of said cam groove, and said lever member being pivotally moved from a provisionally-retaining position to a completely-retaining position so as to guide each guide pin along said cam groove, thereby moving said mating connector in such a direction as to fit it into said connector portion;

retaining means for locking said connection box body and said lower cover to each other in a mutually-fitted condition only when said lever member is in said provisionally-retaining position where each guide pin can be introduced into said introducing port of said cam groove, and said retaining means is provided on those portions of said connection box body and said lower cover to be opposed to each other; and a projected portion formed on that portion of an outer peripheral surface of said cam side plate, disposed in opposite relation to said introducing port, and said projected portion projecting outwardly beyond an obverse surface of an operating portion of said lever member.

6. An electric connection box according to claim 5, wherein said projected portion is formed integrally on the outer peripheral surface of said cam side plate, and has a generally arcuate shape, and projects to the vicinity of the upper surface of said connection box body.

7. A structure of fitting a connector into an electric connection box comprising:

a connection box body having a lever support portion formed at an upper surface thereof and a connector portion formed at a lower side thereof for fitting on the mating connector;

a lower cover covering the lower side of said connection box body, and having a connector retaining portion formed on a bottom surface thereof, said mating connector to be fitted into said connector portion being adapted to be retained on said connector retaining portion;

a lever member pivotally supported on support shafts of said lever support portion, and pivotally moved to bring said mating connector into and out of fitting engagement with said connector portion; and guide means for guiding said mating connector, which is to be retained on said connector retaining portion, into a proper fitting position relative to said connector portion, said guide means being provided on a side wall of said lower cover.

8. A structure of fitting a connector into an electric connection box according to claim 7, wherein said guide means includes a pair of guide rails which are formed on the side wall of said lower cover so as to hold and guide one end portion of said mating connector, and guide ribs for being engaged respectively with said guide rails are formed on the one end portion of said mating connector.

9. A structure of fitting a connector into an electric connection box according to claim 7, wherein said connector retaining portion includes a retaining post, which is formed upright on the bottom surface of said lower cover, and can be inserted into said mating connector, an engagement arm which is formed on said retaining post, and can be engaged with said mating connector to retain said mating connector relative to said lower cover, and a placing wall which is formed upright on said bottom surface in surrounding relation to said retaining post, and said mating connector can be placed on said placing wall.

10. A structure of fitting a connector into an electric connection box according to claim 8, wherein said connector retaining portion includes a retaining post, which is formed upright on the bottom surface of said lower cover, and can be inserted into said mating connector, an engagement arm which is formed on said retaining post, and can be engaged with said mating connector to retain said mating connector relative to said lower cover, and a placing wall which is formed upright on said bottom surface in surrounding relation to said retaining post, and said mating connector can be placed on said placing wall.

11. A structure of fitting a connector into an electric connection box comprising:

a connection box body having electric part-mounting portions and a side wall formed on and projecting from an upper surface thereof, and having a connector portion formed at a lower side thereof; and a lever member pivotally supported on a lever support portion on said connection box body, and pivotally moved to bring the mating connector into and out of fitting engagement with said connector portion, when said mating connector is completely fitted in said connector portion, a distal end of said mating connector projects beyond said upper surface, wherein said lever member is supported on said lever support portion in such a manner that when said mating connector is completely fitted in said connector portion, a height of said lever member from said upper surface is equal to at least one of a height of said side wall from said upper surface, a height of said distal end of said mating connector from said upper surface and a height of said electric part-mounting portions from said upper surface.

12. A structure of fitting a connector into an electric connection box according to claim 11, in which said lever support portion includes a pair of support walls, formed on and projecting from said upper surface of said connection box body, and support shafts formed on and projecting respectively from opposed surfaces of said support walls, and said lever member includes a pair of cam side plates, and an operating portion which is provided between said pair of cam side plates, and can be operated to pivotally move said lever member, and each of said cam side plates has a bearing hole, receiving and bearing the associated support shaft, and a cam groove for receiving an associated guide pin of said mating connector, and in said completely-fitted condition, a height of said operating portion from said upper surface is equal to at least one of the height of said side wall from said upper surface, the height of said distal end of said mating connector from said upper surface and the height of said electric part-mounting portions from said upper surface.

13. A structure of fitting a connector into an electric connection box according to claim 11, wherein the plurality of said electric part-mounting portions are formed on and project from said upper surface, and end surfaces of said electric part-mounting portions, an end surface of said side wall, an end surface of said distal end of said mating connector and said lever member are disposed in a common plane.

14. A structure of fitting a connector into an electric connection box according to claim 12, wherein the plurality of said electric part-mounting portions are formed on and project from said upper surface, and end surfaces of said electric part-mounting portions, an end surface of said side wall, an end surface of said distal end of said mating connector and said lever member are disposed in a common plane.

* * * * *